US011920419B2

(12) United States Patent
Massey

(10) Patent No.: US 11,920,419 B2
(45) Date of Patent: Mar. 5, 2024

(54) DOWNHOLE CONVEYANCE LINE CUTTER

(71) Applicant: Impact Selector International, LLC, Heath, TX (US)

(72) Inventor: James Patrick Massey, Leadville, CO (US)

(73) Assignee: Impact Selector International, LLC, Heath, TX (US)

( * ) Notice: Subject to any disclaimer, the term of this patent is extended or adjusted under 35 U.S.C. 154(b) by 0 days.

(21) Appl. No.: 17/935,337

(22) Filed: Sep. 26, 2022

(65) Prior Publication Data

US 2023/0013835 A1 Jan. 19, 2023

Related U.S. Application Data

(62) Division of application No. 17/249,315, filed on Feb. 26, 2021, now Pat. No. 11,560,766.

(60) Provisional application No. 62/983,245, filed on Feb. 28, 2020.

(51) Int. Cl.
*E21B 29/04* (2006.01)
*E21B 17/02* (2006.01)

(52) U.S. Cl.
CPC ..... *E21B 29/04* (2013.01); *E21B 17/023* (2013.01)

(58) Field of Classification Search
CPC ..... E21B 29/04; E21B 17/023
See application file for complete search history.

(56) References Cited

U.S. PATENT DOCUMENTS

| | | | | |
|---|---|---|---|---|
| 969,755 | A | 9/1910 | Spang | |
| 4,405,263 | A * | 9/1983 | Hall | E21B 41/04 114/294 |
| 4,738,312 | A | 4/1988 | Wittrisch | |
| 4,746,246 | A | 5/1988 | Cowan et al. | |
| 5,246,075 | A * | 9/1993 | Caulfield | E21B 41/10 405/195.1 |
| 5,720,348 | A * | 2/1998 | Hisaw | E21B 29/04 166/54.5 |

(Continued)

FOREIGN PATENT DOCUMENTS

WO 2015048002 A1 4/2015

OTHER PUBLICATIONS

PCT/US2021/070198 International Search Report and Written Opinion of the International Searching Authority dated Aug. 2, 2021, 16 pages.

*Primary Examiner* — Taras P Bemko
(74) *Attorney, Agent, or Firm* — Boisbrun Hofman, PLLC

(57) ABSTRACT

A downhole conveyance line cutter operable to be conveyed downhole within a wellbore along a conveyance line that conveys a tool string within the wellbore, connect to the conveyance line, and cut the conveyance line. The downhole conveyance line cutter may comprise a body, a cutting member operable to cut the conveyance line, and a clamping mechanism operable to connect the downhole conveyance line cutter to the conveyance line. The clamping mechanism may comprise a clamping member pivotably connected with the body and an actuator operable to pivot the clamping member to cause the clamping member to engage the conveyance line thereby connecting the downhole tool to the conveyance line such that the downhole tool can be retrieved out of the wellbore via the conveyance line after the downhole tool cuts the conveyance line.

20 Claims, 11 Drawing Sheets

(56) References Cited

U.S. PATENT DOCUMENTS

| | | | | |
|---|---|---|---|---|
| 7,963,319 | B2 * | 6/2011 | Daigle | E21B 29/04 166/54.5 |
| 10,156,111 | B2 * | 12/2018 | Clemens | E21B 29/04 |
| 2002/0152856 | A1 * | 10/2002 | Brumley | E21B 29/04 83/13 |
| 2010/0170675 | A1 | 7/2010 | Daigle et al. | |
| 2010/0181072 | A1 | 7/2010 | Gillan | |
| 2016/0281462 | A1 | 9/2016 | Rytlewski et al. | |
| 2021/0270102 | A1 | 9/2021 | Massey | |

* cited by examiner

DOWNHOLE CONVEYANCE LINE CUTTER

CROSS-REFERENCE TO RELATED APPLICATIONS

This application is a divisional of U.S. patent application Ser. No. 17/249,315, titled "DOWNHOLE CONVEYANCE LINE CUTTER," filed on Feb. 26, 2021, which claims priority to and the benefit of U.S. Provisional Application No. 62/983,245, titled "DOWNHOLE CONVEYANCE LINE CUTTER," filed Feb. 28, 2020, the entire disclosures of which are hereby incorporated herein by reference.

BACKGROUND OF THE DISCLOSURE

Wells are generally drilled into land surface or ocean bed to recover natural deposits of oil, gas, and other natural resources that are trapped in subterranean geological formations in the Earth's crust. Testing and evaluation of completed and partially finished wells has become commonplace, such as to increase well production and return on investment. Downhole measurements (e.g., formation pressure, formation permeability, etc.) and recovery of formation fluid samples may be useful for predicting economic value, production capacity, and production lifetime of geological formations. Completion and stimulation operations of wells, such as perforating and fracturing operations, may also be performed to optimize well productivity. Plugging and perforating tools may be utilized to set plugs within a wellbore to isolate portions of the wellbore and formations surrounding the wellbore from each other and to perforate the well in preparation for fracturing. Each fracturing stage interval along the wellbore can be perforated with one or more perforating tools forming one or more clusters of perforation tunnels. Intervention operations in completed wells, such as installation, removal, or replacement of various production equipment, may also be performed as part of well repair, maintenance operations, or permanent abandonment. Such testing, completion, intervention, and other downhole operations have become complicated, as wellbores are drilled deeper and through more difficult materials.

A downhole tool string comprising one or more downhole tools may be deployed within a wellbore via a conveyance line to perform downhole operations. The tool string may be conveyed along the wellbore by applying controlled tension to the tool string from a wellsite surface via the conveyance line. However, in working with deeper and more complex wellbores, it has become more likely that a tool string or other downhole equipment may become stuck or jammed within a wellbore.

When a downhole tool string becomes stuck within a wellbore, the conveyance line may be disconnected from the tool string, such as by applying tension to the conveyance line from the wellsite surface sufficient to break the conveyance line at a cable head of the tool string or cause the conveyance line to be released by the cable head. Fishing equipment may then be conveyed downhole to couple with the stuck tool string to retrieve the tool string to the wellsite surface. However, if the conveyance line does not disconnect from the tool string, a downhole cutting tool may be conveyed downhole to the tool string to cut the conveyance line at the tool string.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces a downhole tool operable to be conveyed downhole within a wellbore along a conveyance line that conveys a tool string within the wellbore and then cut the conveyance line, wherein the downhole tool comprises a body, a fluid chamber within the body, a piston slidably disposed within the fluid chamber, a knife that is movable with respect to the body, an arm operatively connecting the piston and the knife, and a fluid source operable to pump a fluid into the fluid chamber to cause the piston to move the arm which moves the knife to cut the conveyance line.

The present disclosure also introduces a downhole tool operable to be conveyed downhole within a wellbore along a conveyance line that conveys a tool string within the wellbore and then cut the conveyance line, wherein the downhole tool comprises a body and a nose section detachably connected to the body, wherein the nose section is configured to contact an upper end of the tool string conveyed via the conveyance line, and wherein the nose section comprises an outer diameter that is larger than an outer diameter of the body.

The present disclosure also introduces a downhole tool operable to be conveyed downhole within a wellbore and cut a conveyance line that conveys a tool string within the wellbore, wherein the downhole tool comprises a body defining an axial passage configured to accommodate the conveyance line therethrough such that the downhole tool can be conveyed downhole within the wellbore along the conveyance line until the downhole tool contacts the tool string. The downhole tool also comprises a clamping mechanism operable to connect the downhole tool to the conveyance line. The clamping mechanism comprises a clamping member pivotably connected with the body, as well as an actuator operable to pivot the clamping member to cause the clamping member to engage the conveyance line thereby connecting the downhole tool to the conveyance line such that the downhole tool can be retrieved out of the wellbore via the conveyance line after the downhole tool cuts the conveyance line.

These and additional aspects of the present disclosure are set forth in the description that follows, and/or may be learned by a person having ordinary skill in the art by reading the material herein and/or practicing the principles described herein. At least some aspects of the present disclosure may be achieved via means recited in the attached claims.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
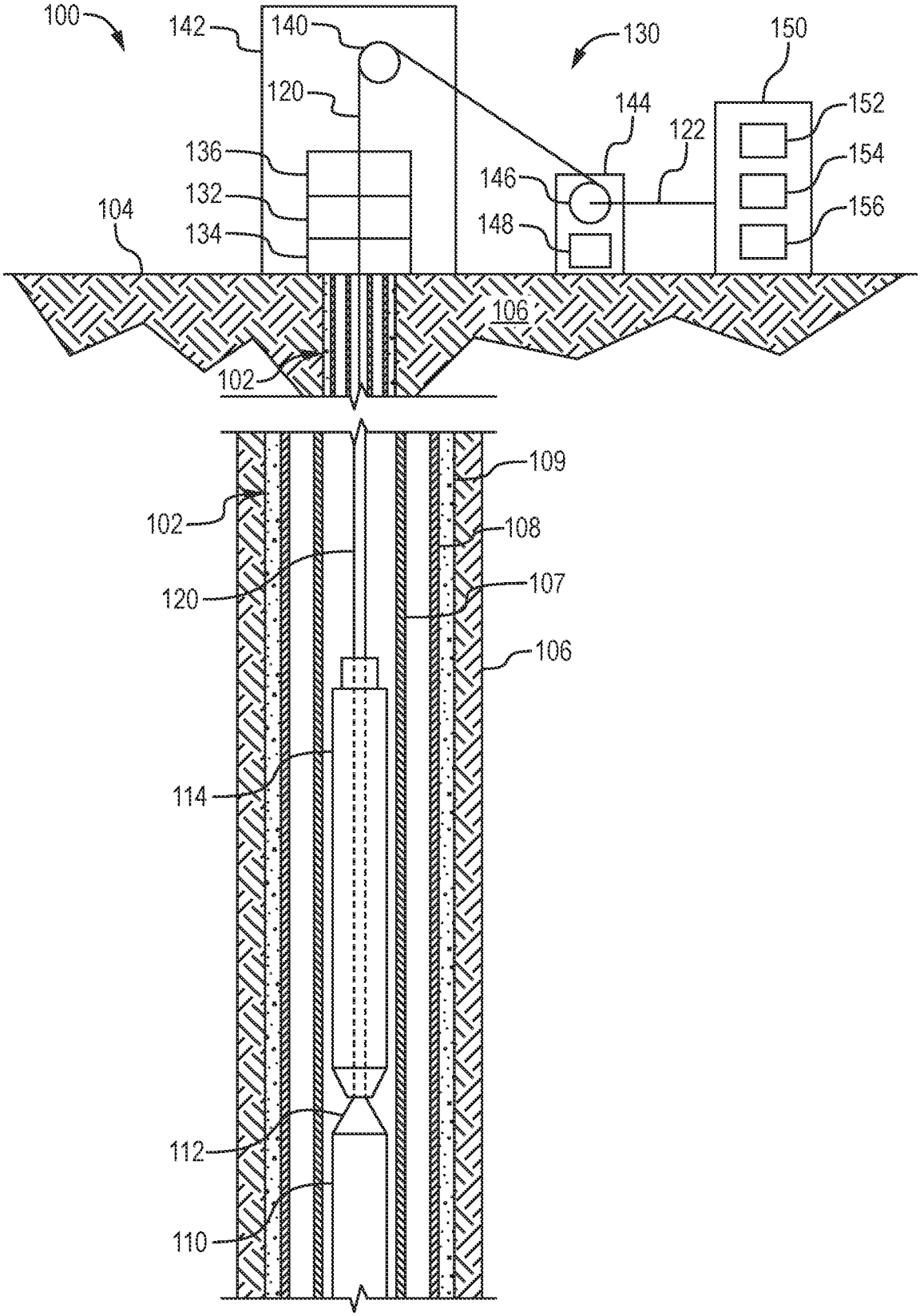
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows, may include embodiments in which the first and second features are formed in direct contact, and may also include embodiments in which additional features may be formed interposing the first and second features, such that the first and second features may not be in direct contact.

Terms, such as upper, upward, above, lower, downward, and/or below are utilized herein to indicate relative positions and/or directions between apparatuses, tools, components, parts, portions, members, and/or other elements described herein, as shown in the corresponding figures. Such terms do not necessarily indicate relative positions and/or directions when actually implemented. Such terms, however, may indicate relative positions and/or directions with respect to a wellbore when an apparatus according to one or more aspects of the present disclosure is utilized or otherwise disposed within the wellbore. For example, the term upper may mean in the uphole direction, and the term lower may mean in the downhole direction.

FIG. 1 is a schematic view of at least a portion of an example implementation of a wellsite system 100 according to one or more aspects of the present disclosure, representing an example environment in which one or more aspects of the present disclosure may be implemented. The wellsite system 100 is depicted in relation to a wellbore 102 formed by rotary and/or directional drilling and extending from a wellsite surface 104 into a subterranean formation 106. A lower portion of the wellbore 102 is shown enlarged compared to an upper portion of the wellbore 102 adjacent the wellsite surface 104 to permit a larger and therefore a more detailed depiction of various tools, tubulars, devices, and other objects disposed within the wellbore 102. The wellsite system 100 may be utilized to facilitate recovery of oil, gas, and/or other materials that are trapped in the subterranean formation 106. At least a portion of the wellbore 102 may be a cased-hole wellbore 102 comprising a casing 108 secured by cement 109, and/or a portion of the wellbore 102 may be an open-hole wellbore 102 lacking the casing 108 and cement 109. The wellbore 102 may also or instead contain a fluid conduit 107 (e.g., a production tubing) disposed within at least a portion of the casing 108 and/or an open-hole portion of the wellbore 102. Thus, one or more aspects of the present disclosure are applicable to and/or readily adaptable for utilizing in a cased-hole portion of a wellbore 102, an open-hole portion of a wellbore 102, and/or a fluid conduit 107 disposed within a cased-hole and/or open-hole portion of a wellbore 102. It is also noted that although the wellsite system 100 is depicted as an onshore implementation, it is to be understood that the aspects described below are also generally applicable to offshore implementations.

The wellsite system 100 includes surface equipment 130 located at the wellsite surface 104. The wellsite system 100 also includes or is operable in conjunction with a downhole intervention and/or sensor assembly, referred to as a tool string 110, conveyed within the wellbore 102 via a conveyance line 120 operably coupled with one or more pieces of the surface equipment 130. The conveyance line 120 may be operably connected with a conveyance device 140 operable to apply an adjustable downward- and/or upward-directed force to the tool string 110 via the conveyance line 120 to convey the tool string 110 within the wellbore 102. The conveyance line 120 may be or comprise coiled tubing, a cable, a wireline, a slickline, a multiline, or an e-line, among other examples. The conveyance device 140 may be, comprise, or form at least a portion of a sheave or pulley, a winch, a drawworks, an injector head, and/or another device coupled to the tool string 110 via the conveyance line 120. The conveyance device 140 may be supported above the wellbore 102 via a mast, a derrick, a crane, and/or other support structure 142. The surface equipment 130 may further comprise a reel or drum 146 configured to store thereon a wound length of the conveyance line 120, which may be selectively wound and unwound by the conveyance device 140 to selectively convey the tool string 110 into, along, and out of the wellbore 102.

Instead of or in addition to the conveyance device 140, the surface equipment 130 may comprise a winch conveyance device 144 comprising or operably connected with the drum 146. The drum 146 may be rotated by a rotary actuator 148 (e.g., an electric motor) to selectively unwind and wind the conveyance line 120 to apply an adjustable tensile force to the tool string 110 to selectively convey the tool string 110 into, along, and out of the wellbore 102.

The conveyance line 120 may comprise one or more metal support wires or cables configured to support the weight of the downhole tool string 110. The conveyance line 120 may comprise and/or be operable in conjunction with means for communication between the tool string 110, the conveyance device 140, the winch conveyance device 144, and/or one or more other portions of the surface equipment 130, including a power and control system 150. For example, the conveyance line 120 may comprise one or more insulated electrical and/or optical conductors 122 operable to transmit electrical energy (i.e., electrical power) and electrical and/or optical signals (e.g., information, data, etc.) between the tool string 110 and one or more components of the surface equipment 130, such as the power and control system 150.

The power and control system 150 (e.g., a control center) may be utilized to monitor and control various portions of the wellsite system 100 automatically and/or by a human operator. The power and control system 150 may be located at the wellsite surface 104 or on a structure located at the wellsite surface 104. However, the power and control system 150 may instead be located remote from the wellsite surface 104. The power and control system 150 may include a source of electrical power 152, a memory device 154, and a surface controller 156 (e.g., a processing device, a computer, etc.) operable to receive and process signals or information from the tool string 110 and/or commands from the wellsite operator. The power and control system 150 may be communicatively connected with various equipment of the wellsite system 100, such as may permit the surface controller 156 to monitor operations of one or more portions of the wellsite system 100 and/or to provide control of one or more portions of the wellsite system 100, including the tool string 110, the conveyance device 140, and/or the winch conveyance device 144. The surface controller 156 may include input devices for receiving commands from the wellsite operator and output devices for displaying information to the wellsite operator. The surface controller 156 may store executable programs and/or instructions, including for implementing one or more aspects of methods, processes, and operations described herein.

The wellbore 102 may be capped by a plurality (e.g., a stack) of fluid control devices 132, which may include a Christmas tree comprising fluid control valves, spools, and fittings individually and/or collectively operable to direct and control the flow of fluid out of the wellbore 102. The fluid control devices 132 may also or instead comprise a blow-out preventer (BOP) stack operable to prevent the flow of fluid out of the wellbore 102. The fluid control devices 132 may be mounted on top of a wellhead 134.

The surface equipment 140 may further comprise a sealing and alignment assembly 136 mounted on the fluid control devices 132 and operable to seal the conveyance line 120 during deployment, conveyance, intervention, and other wellsite operations. The sealing and alignment assembly 136 may comprise a lock chamber (e.g., a lubricator, an airlock, a riser, etc.) mounted on the fluid control devices 132, a stuffing box operable to seal around the conveyance line 120 at top of the lock chamber, and return pulleys operable to guide the conveyance line 120 between the stuffing box and the drum 146, although such details are not shown in FIG. 1. The stuffing box may be operable to seal around an outer surface of the conveyance line 120, for example via annular packings applied around the surface of the conveyance line 120 and/or by injecting a fluid between the outer surfaces of the conveyance line 120 and an inner wall of the stuffing box. The tool string 110 may be deployed into or retrieved from the wellbore 102 via the conveyance device 140 and/or winch conveyance device 144 through the control devices 132, the wellhead 134, and/or the sealing and alignment assembly 136.

The fluid conduit 107 may be installed within the casing 108 and held in position by packers (not shown) and/or other devices. The tool string 110 may thus be conveyed within the wellbore 102 (e.g., within the fluid conduit 107, the casing 108 if the fluid conduit 107 is not installed, or the open-hole wellbore if the casing 108 and conduit 107 are not installed) to perform various downhole intervention and other downhole operations. The tool string 110 may further comprise at least a portion of one or more downhole devices, modules, subs, and/or other tools (not shown) operable to perform such downhole operations. The tool string 110 may comprise a cable head 112 (e.g., a logging head, a cable termination sub, etc.) operable to physically and/or electrically connect the conveyance line 120 with the tool string 110. The cable head 112 may thus permit the tool string 110 to be suspended and conveyed within the wellbore 102 via the conveyance line 120.

When the tool string 110 becomes stuck or jammed within the wellbore 102, tension may be applied to the conveyance line 120 in an attempt to free the tool string 110. If the tool string 110 cannot be freed, additional tension may be applied to break armor wires of the conveyance line 120 at the cable head 112 to disconnect the conveyance line 120 from the tool string 110. Additional tension may also or instead be applied to break a shear pin of a release tool (not shown) coupled along the tool string 110 to free a portion of the tool string 110 above the release tool, including the cable head 112. If the conveyance line 120 does not disconnect from the tool string 110 and the release tool fails, a downhole conveyance line cutting tool 114 ("a cutter") may be conveyed (e.g., slid) downhole along the conveyance line 120 until the cutter 114 contacts the tool string 110. The cutter 114 may then be operated to perform cutting operations to cut the conveyance line 120 at (e.g., just above) the tool string 110. Fishing equipment (not shown) may then be conveyed within the wellbore 102 to couple with the stuck tool string 110 and retrieve the tool string 110 to the wellsite surface 104.

Figure 2:
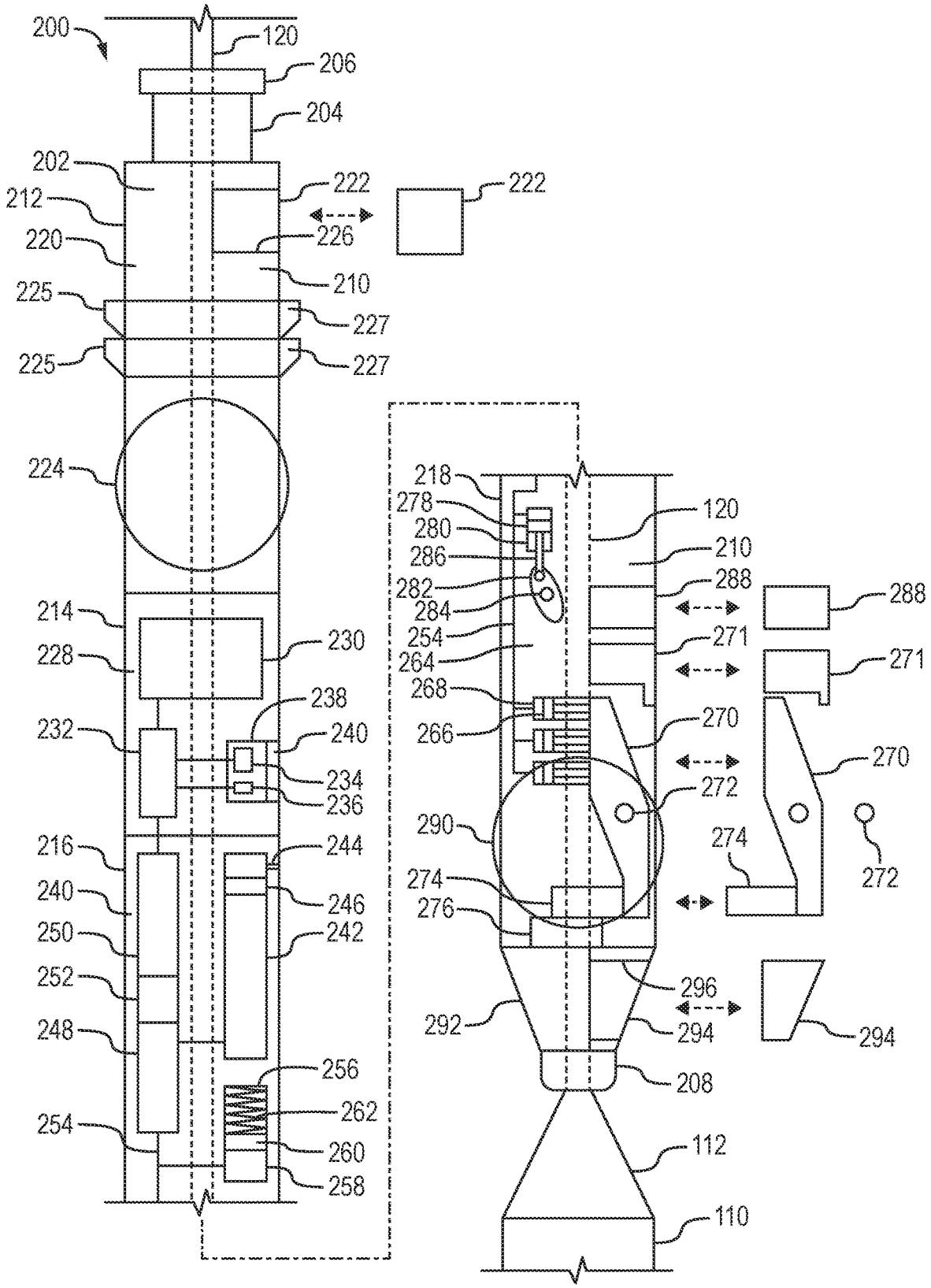
FIG. 2 is a schematic view of at least a portion of an example implementation of apparatus according to one or more aspects of the present disclosure.

FIG. 2 is a schematic view of at least a portion of an example implementation of a cutter 200 according to one or more aspects of the present disclosure. The cutter 200 may be slidably connected with a conveyance line 120, slid downhole along the conveyance line 120 until the cutter 200 contacts the tool string 110, and then operated to perform cutting operations to cut the conveyance line 120 at or just above (e.g., between 2 and 25 centimeters above) the tool string 110. The cutter 200 may be or comprise the cutter 114 described above and shown in FIG. 1 or may comprise one or more features and/or modes of operation of the cutter 114. Accordingly, the following description refers to FIGS. 1 and 2, collectively.

The cutter 200 may comprise a body 202 (or a housing, block, etc.) forming or otherwise defining one or more internal spaces, volumes, bores, and/or chambers for accommodating, receiving, or otherwise containing a conveyance line 120 and various components of the cutter 200. An upper (i.e., uphole) end of the cutter 200 may comprise a neck 204 and/or internal or external features or profiles 206. The neck 204 and/or the internal or external features or profiles 206 may individually or collectively facilitate or otherwise permit the cutter 200 to be coupled with downhole fishing equipment (not shown) during fishing operations, for example, if the cutter 200 is not retrieved to the wellsite surface 104 via the conveyance line 120 after the conveyance line 120 is cut by the cutter 200. The neck 204 and/or the internal or external features or profiles 206 may comprise one or more external cavities, protrusions, and/or other profiles (e.g., an external fishing neck profile) operable for coupling with the wellbore fishing equipment (e.g., an outside grappling device) during the fishing operations. However, the upper end of the cutter 200 may not comprise internal or external features or profiles 206, but instead a substantially smooth or uniform outer surface, such as may permit the cutter 200 to be received or captured by an overshot fishing tool (e.g., an external catch) during the fishing operations. The neck 204 and/or the internal or external features or profiles 206 may also or instead comprise one or more internal cavities, protrusions, or other profiles (e.g., an internal fishing neck profile), which may permit the fishing equipment (e.g., an inside grappling device, a spear, etc.) to enter and thread into or otherwise latch against the internal profile during the fishing operations.

A lower (i.e., downhole) end of the cutter 200 may comprise a nose section 292 terminating with a bumper 208 configured to contact an upper end (e.g., a cable head 112) of a tool string 110 when the cutter 200 is conveyed downhole within the wellbore 102. The bumper 208 may dampen the impact between the cutter 200 and the tool string 110 when the cutter 200 reaches the tool string 110. The cutter 200 may comprise a channel 210 (or slot) extending radially on one side of the cutter 200 from a central axis of the cutter 200 to an outer surface of the cutter 200, and longitudinally (e.g., axially) through or along the cutter 200 between opposing upper and lower ends of the cutter 200. The channel 210 may extend into and through the body 202, the neck 204, and the nose section 292. The channel 210 may be configured to accommodate or otherwise receive the conveyance line 120, such as may permit the cutter 200 to connect to the conveyance line 120 and be conveyed (e.g., slid) downhole along the conveyance line 120.

The cutter 200 may be or comprise a cutter assembly comprising a plurality of sections (or modules) connected together to form the cutter 200, wherein each section comprises a predetermined structure and performs a predetermined operation of the cutter 200. The cutter 200 may comprise a conveyance section 212, an electrical power and control section ("an electrical section") 214, a fluid power section 216, and a cutting section 218. Each section 212, 214, 216, 218 comprises a corresponding body (or a housing, block, etc.) forming or otherwise defining one or more internal spaces, volumes, bores, and/or chambers for accommodating, receiving, or otherwise containing the conveyance line 120 and various components of that section 212, 214, 216, 218. Accordingly, the body 202 may be a body assembly comprising a plurality of body sections (or modules) connected together to form the body 202. A plurality of mechanical, fluid, and/or electrical interfaces (e.g., subs, crossovers, connectors, etc.) (not shown) may mechanically, fluidly, and/or electrically connect the sections 212, 214, 216, 218 to collectively form the cutter 200. For example, one or more of such interfaces may comprise one or more of a mechanical coupling means (e.g., threads, flanges, fasteners, etc.) to mechanically connect the bodies of the sections 212, 214, 216, 218, an electrical coupling means (e.g., electrical connectors, conductors, bulkheads, and/or stabbers, etc.) to electrically connect two or more of the sections 212, 214, 216, 218, and a fluid coupling means (e.g., fluid connectors, conductors, bulkheads, and/or stabbers) to fluidly connect two or more of the sections 212, 214, 216, 218.

The conveyance section 212 may comprise a body 220 (or a housing, block, etc.) defining a portion of the channel 210. The conveyance section 212 may further comprise an upper conveyance line retaining block or another member 222 ("retainer") configured to be connected with the body 220 to maintain or otherwise retain the conveyance line 120 within the channel 210, and thus maintain the cutter 200 slidably connected with the conveyance line 120. The retainer 222 may be a separate and distinct member removable from the body 220 and configured to be selectively disposed within a corresponding cavity 226 extending within the body 220 along the channel 210 and against the conveyance line 120 located within the channel 210. The retainer 222 may be fixedly connected to the body 220 via one or more fasteners (not shown), such as threaded bolts. The conveyance section 212 may further comprise a plurality of upper wheels 224 rotatably connected with the body 220. The wheels 224 may aid in reducing friction between the cutter 200 and an internal surface (e.g., a sidewall) of the wellbore 102 (e.g., the fluid conduit 107, the casing 108 if the fluid conduit 107 is not installed, or the open-hole wellbore if the casing 108 and conduit 107 are not installed) to facilitate downhole conveyance of the cutter 200 along the conveyance line 120. The neck 204 and/or the internal or external features or profiles 206 may form a portion of or be connected with the body 220 of the conveyance section 212.

Figure 5:
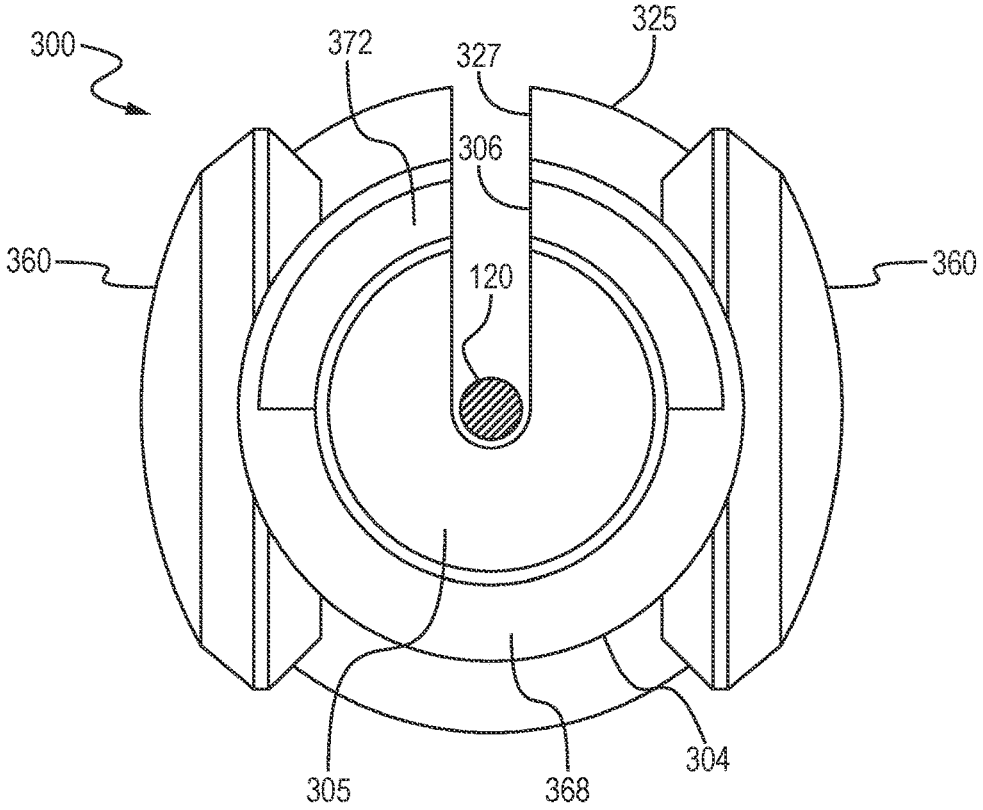
FIG. 5 is an axial view of the apparatus shown in FIGS. 3 and 4 in a stage of assembly operations.
Figure 6:
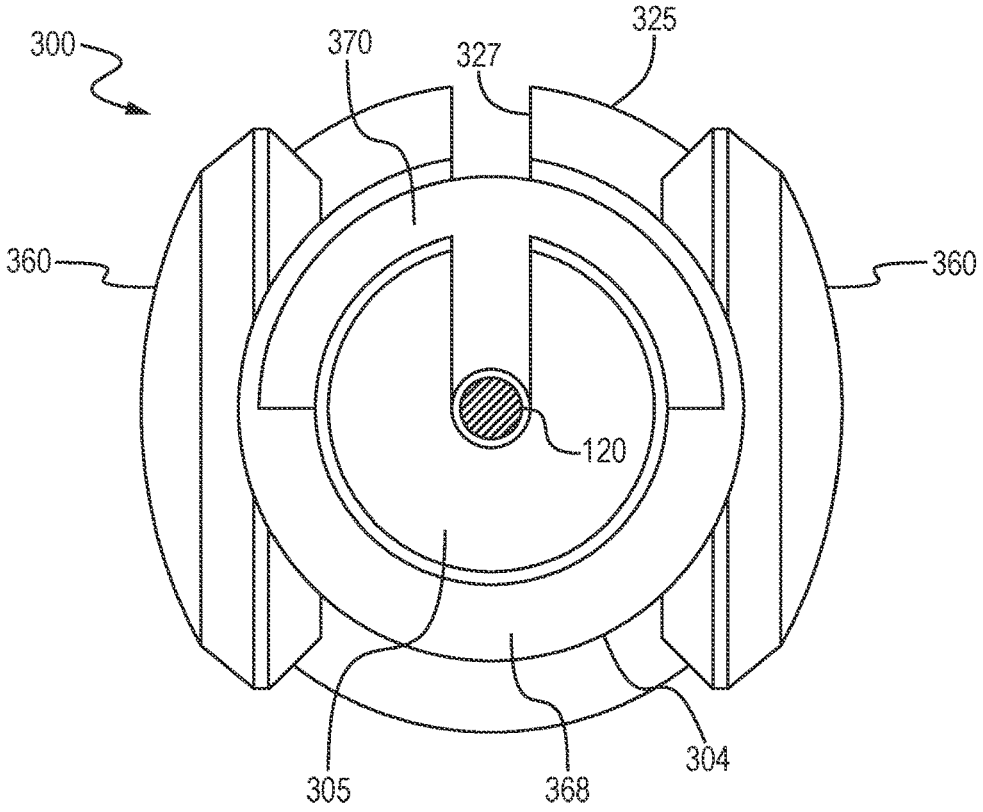
FIG. 6 is an axial view of the apparatus shown in FIG. 5 in a different stage of assembly operations.

Instead of or in addition to the wheels 224, the conveyance section 212 (or another section) of the cutter 200 may comprise one or more cups 225 (e.g., swab cups) connected with the body 220 to aid or otherwise facilitate downhole conveyance of the cutter 200 along the conveyance line 120. The cups 225 may be or comprise sealing members (e.g., cup seals) fluidly sealing against the body 220. The cups 225 may be configured to fluidly seal against an internal surface of the wellbore 102 surrounding the cutter 200 when the cutter 200 is conveyed within the wellbore 102. Each cup 225 may extend radially away from the body 220 and circumferentially around the body 220, thereby increasing an axial profile and axial surface area of the cutter 200. Each cup 225 may have a substantially circular axial profile. An outer diameter of the cups 225 may be substantially equal to an internal diameter of the wellbore 102, or the outer diameter of the cups 225 may be slightly smaller than the inner diameter of the wellbore 102. The outer diameter of the cups 225 may be larger than or smaller than an outer diameter of the wheels 224. The axial profile or circumference of the cups 225 may be larger than or encompass an axial profile of the wheels 224, or the axial profile or circumference of the cups 225 may be smaller than or not encompass the axial profile of the wheels 224 (e.g., as shown in FIGS. 5 and 6). Each cup 225 may comprise a channel 227 (or slot) extending radially and axially on one side of the cup 225. Accordingly, the cups 225 extend circumferentially around most, but not all, of the body 220. The channels 227 may be aligned with the channel 210, such as may permit the conveyance line 120 to be received into the channel 210.

The cups 225 permit the cutter 200 to be pumped downhole with increased efficiency. For example, a fluid (e.g., water) may be pumped into the wellbore 102 behind (uphole from) the cutter 200 to increase pressure behind the cutter 200, thereby forming a pressure differential across the cutter 200 that pushes the cutter 200 downhole along the wellbore 102. The cups 225 may decrease downhole flow rate of the pumped fluid around and past the cutter 200, thereby permitting a higher pressure differential to be maintained across the cutter 200. The cups 225 may increase friction of the passing fluid against the cutter 200, therefore increasing drag or friction forces of the passing fluid against the cutter 200. The cups 225 and pumping operations may be used, for example, to move or help move the cutter 200 downhole along horizontal and/or curved portions of the wellbore 102 in which gravity alone may not be sufficient to move the cutter 200. The cups 225 may operate to decrease rate of descent of the cutter 200 along vertical or near-vertical portions of the wellbore 102. For example, the cups 225 may operate as a drogue, increasing axial surface area of the cutter 200 to increase drag or friction forces against the sidewall of the wellbore 102 and/or against wellbore fluid within the wellbore 102, thereby decreasing the rate of descent of the cutter 200. The cups 225 may decrease flow rate of the wellbore fluid around and past the cutter 200 while the cutter 200 descends downhole to maintain or otherwise facilitate a higher pressure in front of (downhole from) the cutter 200, thereby decreasing the rate of descent of the cutter 200. A lower rate of descent of the cutter 200 results in a lower impact force or shock against the tool string 110 when the cutter 200 reaches the tool string 110.

The electrical section 214 may comprise a body 228 (or a housing, block, etc.) defining a portion of the channel 210. The electrical section 214 may comprise an electrical power source 230, such as a battery, a capacitor, and/or another source of electrical power. The electrical power source 230 may provide electrical power to various electrical components and actuators of the cutter 200. The electrical section 214 may further comprise a controller 232 operable to receive control commands, monitor the cutter 200, and control the cutter 200 based on programming and the received control commands. The controller 232 may be electrically connected with the electrical power source 230 and with various electrical components of the cutter 200, including the electrical actuators of the cutter 200. The controller 232 may comprise a processing device and a memory operable to store computer programs or instructions ("code") that, when executed by the processing device, may cause the cutter 200 to perform methods, processes, and/or operations described herein, among others. The controller 232 may comprise a timer and one or more drivers operable to control the electrical actuators and other electrical components of the cutter 200. The controller 232 may be operable to receive, store, and/or process operational set-points (e.g., time-delay commands) entered by a human operator. The controller 232 may output control commands to the electrical actuators of the cutter 200, such as to perform various operations of the cutter 200 described herein based on prior programming and/or the received operational set-points.

The controller 232 may be communicatively (e.g., electrically) connected with an input device 234 operable by the human operator to input the operational set-points and other control commands to the controller 232. The input device 234 may be or comprise an electrical keypad or selector switch that can be manually operated (e.g., rotated, pressed, etc.) by the human operator to select one of a plurality of modes of operation of the cutter 200. The modes of operation may comprise turning the cutter 200 on and off, and may further comprise different time delay settings for the cutter 200 to cut the conveyance line 120 after the cutter 200 is conveyed downhole to the tool string 110. The controller 232 may also or instead be communicatively connected with an electrical output device 236 operable to output visual information (e.g., feedback) indicative of an operational status of the cutter 200, including the mode of operation selected by the human operator. For example, the electrical output device 236 may be or comprise light-emitting diode (LED) elements operable to display text, numbers, and/or other indications of a mode of operation selected by the human operator and/or an operational status of the cutter 200. The electrical output device 236 may also or instead be or comprise LED indicators operable to turn on and off in a predetermined order, combination, frequency, and/or color to indicate the mode of operation selected by the human operator and/or operational status of the cutter 200.

The electrical power source 230 and the controller 232 may be fully encompassed within the body 228. The electrical input device 234 and the electrical output device 236 may be disposed within a cavity 238 (or port) in the body 228 having an opening in an external surface of the body 228, such as may permit the human operator to operate the electrical input device 234 to select a mode of operation of the cutter 200 after the cutter 200 is assembled and to view the selected mode of operation and/or operational status of the cutter 200. The cavity 238 may be enclosed by a plug 240 to fluidly seal the electrical input device 234 and the electrical output device 236 before conveying the cutter 200 downhole.

The fluid power section 216 may comprise a body 240 defining a portion of the channel 210. The fluid power section 216 may be operable to output fluid (e.g., hydraulic) power to drive various portions of the cutting section 218 to perform the cutting operations described herein. For example, the fluid power section 216 may comprise a fluid source (e.g., a hydraulic power pack) operable to discharge (i.e., pump) a pressurized fluid to the cutting section 218 to operate fluid actuators of the cutting section 218. The fluid source may comprise a fluid reservoir 242 storing hydraulic or another fluid ("power fluid"). The fluid reservoir 242 may be or comprise a fluid chamber formed within the body 240. The fluid reservoir 242 may be pressure compensated, wherein pressure of the power fluid within the fluid reservoir 242 is equalized with wellbore pressure while the cutter 200 is conveyed downhole. For example, the fluid reservoir 242 may be fluidly connected with the space external to the cutter 200 via a port 244. A floating piston 246 may be slidably disposed within the fluid reservoir 242 to fluidly isolate the power fluid within the fluid reservoir 242 from the wellbore fluid entering the fluid reservoir 242 via the port 244. The fluid source may further comprise a fluid pump 248 fluidly connected with the fluid reservoir 242 and operable to pump (and pressurize) the power fluid from the fluid reservoir 242 to the cutting section 218 to provide fluid power to perform the cutting operations described herein. The fluid pump 248 may be actuated (e.g., rotated) via an electrical motor 250, such as a three-phase, direct-current (DC) motor. A gearbox 252 may be operatively coupled between the electrical motor 250 and the fluid pump 248, such as to control pressure and/or flow rate of the power fluid discharged by the pump 248. The controller 232 may be electrically connected to the electrical motor 250 and operable to control speed and/or torque generated by the electrical motor 250. Accordingly, the controller 232 may be operable to control pressure and/or flow rate of the power fluid discharged by the pump 248.

The fluid pump 248 may be fluidly connected with various fluid actuators of the cutting section 218 via a fluid conduit 254 (or passage) extending between the fluid pump 248 and the fluid actuators. The power fluid within the fluid conduit 254 or otherwise between the fluid pump 248 and the fluid actuators may expand or otherwise increase in volume, such as when ambient temperature within the wellbore 102 increases during downhole conveyance of the cutter 200. The fluid power section 216 may thus further comprise a fluid accumulator 256 (e.g., a hydraulic expansion valve) encompassed within the body 240 and fluidly connected with the fluid conduit 254. The fluid accumulator 256 may be operable to receive the power fluid located within the fluid conduit 254 and/or within the fluid actuators to maintain pressure of such power fluid below a predetermined threshold when the power fluid expands during downhole conveyance of the cutter 200. The fluid accumulator 256 may comprise a fluid reservoir 258 (e.g., a fluid chamber or cylinder) within the body 240, a piston 260 slidably disposed within the fluid reservoir 258, and a biasing member 262 (e.g., a spring) configured to resist movement of the piston 260 within the fluid reservoir when the expanding power fluid flows into the fluid reservoir 258.

The cutting section 218 may comprise a body 264 defining a portion of the channel 210 and encompassing a plurality of fluid actuators and other components collectively operable to perform the cutting operations. The fluid actuators may comprise one or more fluid pistons (or rams) 266 slidably disposed within corresponding fluid chambers 268 (or cylinders) within the body 264. The fluid chambers 268 may be fluidly connected with the fluid pump 248 via the fluid conduit 254. The cutting section 218 may further comprise one or more knives 274, 276 (e.g., blades, cutting blocks, etc.) configured to cut the conveyance line 120 during the cutting operations. The cutting section 218 may further comprise a lever arm 270 pivotably connected with the body 264 via a pivot pin 272. The fluid pistons 266 may be disposed against one end of the arm 270 and the knife 274 may be disposed against an opposing end of the arm 270. The lever arm 270 may be configured to transfer force generated by the pistons 266 to the knife 274, such that movement of the pistons 266 in one direction causes the arm 270 to move the knife 274 in an opposing direction. The lever arm 270, the pivot pin 272, and the knife 274 may be separate and distinct members removable from the body 264 and configured to be operatively connected to the body 264 during cutter assembly operations. One or more stop brackets 271 may be used to limit movement of the lever arm 270 caused by the pistons 266. The stop brackets 271 may extend over a portion of the lever arm 270 and mechanically stop outward movement of the lever arm 270 caused by the pistons 266. The stop brackets 271 may be separate and distinct members removable from the body 264 and configured to be fixedly connected to the body 264 via one or more fasteners (not shown), such as threaded bolts. The fluid chambers 268, the fluid pistons 266, the lever arm 270, and the knives 274, 276 may collectively form a cutting mechanism operable to cut the conveyance line 120 during the cutting operations.

The fluid actuators may further comprise a fluid piston (or ram) 278 slidably disposed within a corresponding fluid chamber 280 (or cylinder) within the body 264. The fluid chamber 280 may be fluidly connected with the fluid pump 248 via the fluid conduit 254. The cutting section 218 may further comprise a movable clamping member 282 pivotably connected with the body 264 via a pivot pin 284. The piston 278 may be mechanically or otherwise operatively connected to the clamping member 282 via a connecting member 286 (e.g., a shaft, a link, an arm, etc.), such that movement of the piston 278 imparts torque to the clamping member 282, thereby causing the clamping member 282 to pivot (or rotate) about the pivot pin 284. The clamping member 282 may be or comprise a non-symmetrical or eccentric member (e.g., a cam) configured to extend laterally toward the conveyance line 120 when pivoted to engage the conveyance line 120. The clamping member 282 may have a circular, oval, pear-shaped, elliptical, or snail/drop profile, among other examples. The clamping member 282 may be pivoted between a normal position, in which the clamping member 282 does not contact or otherwise engage the conveyance line 120, and an engaged position, in which at least a portion of the clamping member 282 compresses or otherwise engages the conveyance line 120 to grip the conveyance line 120, and thus connect the cutter 200 to the conveyance line 120. The clamping member 282 is configured to be wedged against the conveyance line 120 to actively clamp (i.e., grip) the conveyance line 120 even if hydraulic pressure generated by the fluid pump 248 is removed or lost and the piston 278 is not imparting torque to the clamping member 282.

In its engaged position, the clamping member 282 may push the conveyance line 120 against a static clamping member 288 (e.g., a backing plate), resulting in friction between the conveyance line 120, the clamping member 282, and the clamping member 288. The clamping member 288 may also grip the conveyance line 120 to further facilitate the connection of the cutter 200 to the conveyance line 120. The clamping member 288 may be a separate and distinct member removable from the body 264 and configured to be selectively disposed within a corresponding cavity extending within the body 264 along the channel 210 and against (e.g., adjacent to) the conveyance line 120 located within the channel 210. The clamping member 288 may be fixedly connected to the body 264 via one or more fasteners (not shown), such as threaded bolts. The fluid chamber 280, the fluid piston 278, the clamping member 282, the connecting member 286, and the clamping member 288 may collectively form a clamping mechanism operable to connect the cutter 200 to the conveyance line 120 during the cutting operations such that the conveyance line 120 cannot pass through or be pulled out of the channel 210.

The cutting section 218 may further comprise a plurality of lower wheels 290 rotatably connected with the body 264. The lower wheels 290 may aid in reducing friction between the cutter 200 and the internal surface of the wellbore 102, casing 108, or fluid conduit 107 to facilitate downhole conveyance of the cutter 200 along the conveyance line 120. Although the cutter 200 is shown comprising two sets of wheels 224, 290, it is to be understood that the cutter 200 may be conveyed within the wellbore 102 with just the upper wheels 224, with just the lower wheels 290, or with no wheels 224, 290, perhaps based on downhole conditions, such as the diameter, depth, and/or inclination of the internal surface of the wellbore 102, casing 108, or fluid conduit 107.

A lower end of the body 264 may be tapered, forming the nose section 292 of the cutter 200. The nose section 292 may be a portion of or be connected to the cutting section 218. The nose section 292 may terminate with the bumper 208. The nose section 292 may include a lower conveyance line retaining block or another member 294 ("retainer") configured to be connected with the body 264 forming the nose section 292 to maintain or otherwise retain the conveyance line 120 within the channel 210, and thus maintain the cutter 200 slidably connected with the conveyance line 120. The retainer 294 may be a separate and distinct member removable from the body 264 and configured to be selectively disposed within a corresponding cavity 296 extending within the body 264 along the channel 210 and against the conveyance line 120 located within the channel 210. The retainer 294 may be fixedly connected to the body 264 via one or more fasteners (not shown), such as threaded bolts.

Figure 3:
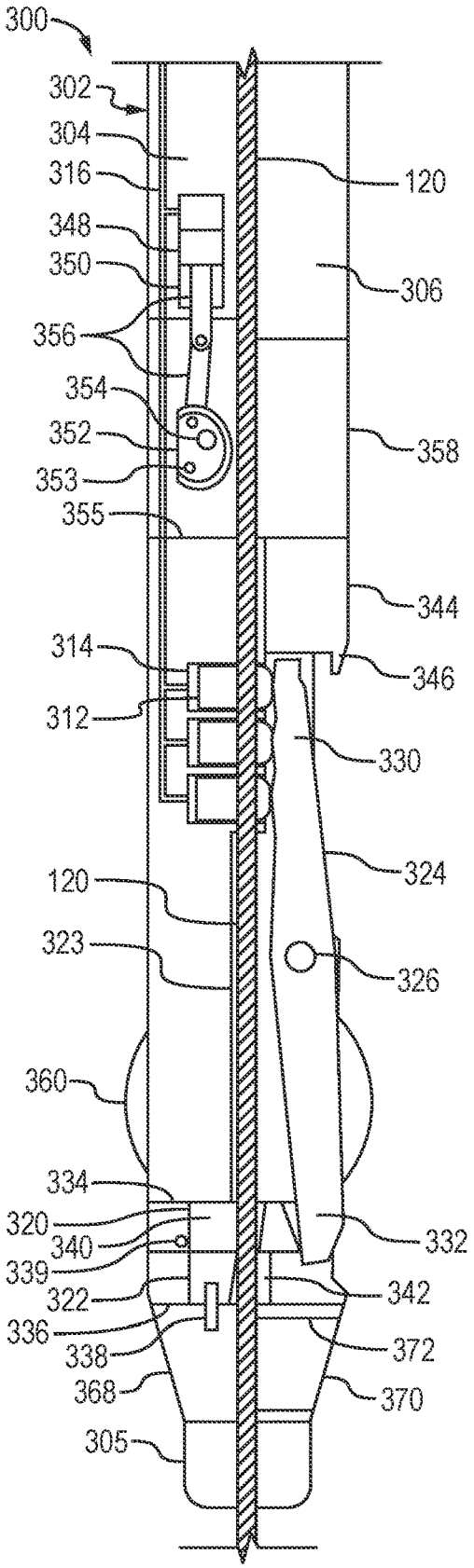
FIG. 3 is a schematic sectional view of at least a portion of an example implementation of apparatus according to one or more aspects of the present disclosure.
Figure 4:
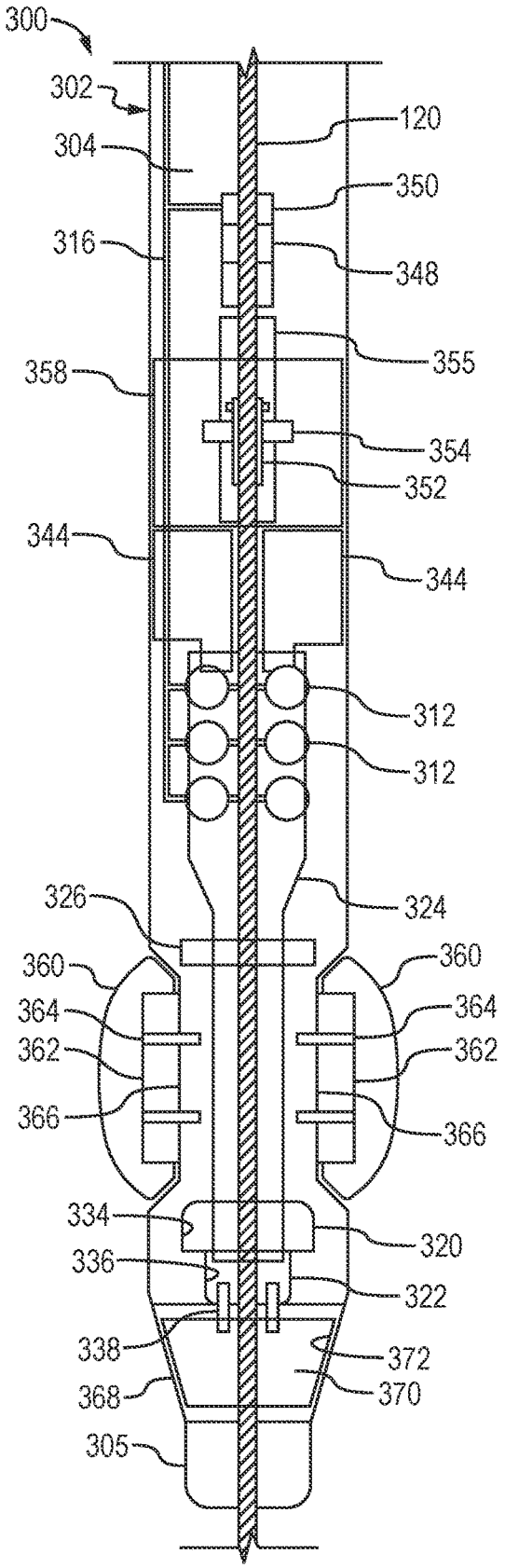
FIG. 4 is another schematic sectional view of the apparatus shown in FIG. 3.

FIGS. 3 and 4 are schematic sectional views of at least a portion of an example implementation of a cutter 300 according to one or more aspects of the present disclosure. FIG. 4 shows outlines of selected features of the cutter 300 to prevent obstruction of view of other features of the cutter 300. The cutter 300 may comprise one or more features and/or modes of operation of the cutters 114, 200 described above and shown in FIGS. 1 and 2, respectively, including where referred to by the same reference numerals. Accordingly, the following description refers to FIGS. 1-4, collectively.

The cutter 300 may include a cutting section 302 comprising a body 304 (or a housing, block, etc.) terminating with a bumper 305 at a lower end of the cutter 300. The bumper 305 may be configured to contact an upper end (e.g., a cable head 112) of a tool string 110 when the cutter 300 is conveyed downhole within a wellbore 102 (e.g., within a fluid conduit 107). The bumper 305 may dampen the impact between the cutter 300 and the tool string 110 when the cutter 300 reaches and contacts the tool string 110. The bumper 305 may comprise a flexible, malleable, or other material that is softer than the material forming the body 304. The bumper 305 may elastically flex or yield (i.e., deform) to reduce the shock to the cutter 300 and the tool string 110, and thus prevent or inhibit damage to the cutter 300 and the tool string 110. The material forming the bumper 305 may be or comprise rubber, Viton, plastic, or another elastically flexible, malleable, or relatively softer material. The body 304 and other portions of the cutter 300 may define a channel 306 (or slot) and encompass a plurality of fluid actuators and other components of the cutter 300 collectively operable to perform cutting operations. The channel 306 may extend radially on one side of the cutter 300 from a central axis of the cutter 300 to an outer surface of the cutter 300 and longitudinally (e.g., axially) through or along the cutter 300 between upper and lower ends of the cutter 300. The channel 306 may extend into and through the body 304 and the bumper 305. The channel 306 may be configured to accommodate or otherwise receive the conveyance line 120, such as may permit the cutter 300, including the cutting section 302, to slidably connect to the conveyance line 120, be conveyed (e.g., slid) downhole along the conveyance line 120, and cut the conveyance line 120 when the cutter 300 reaches the tool string 110.

The fluid actuators may comprise one or more fluid pistons 312 (or rams) slidably disposed within corresponding fluid chambers 314 within the body 304. The fluid chambers 314 may be fluidly connected with a fluid pump 248 via a fluid conduit 316. The cutting section 302 may further comprise one or more knives 320, 322 (e.g., blades, cutting blocks, etc.) configured to cut the conveyance line 120 during the cutting operations. The knife 320 may be movable within or otherwise with respect to the body 304 and the knife 322 may be fixedly disposed within or otherwise fixedly connected with respect to the body 304. For example, the knife 320 may be slidably disposed within a passage 334 (or bore) extending through the body 304 laterally (or perpendicularly) with respect to the conveyance line 120. The knife 322 may be disposed within a passage 336 (or bore) extending through the body 304 laterally (or perpendicularly) with respect to the conveyance line 120. The knife 320 may be temporarily locked or otherwise fixed in position with respect to the body 304 via a shear pin 339 extending through at least a portion of the knife 320 and/or the body 304. The shear pin 339 may maintain the knife 320 in a fixed position before the cutting operations, such as during downhole conveyance. However, the knife 320 may be movable with respect to the knife 322 during the cutting operations. The knife 322 may be locked or otherwise fixed in position with respect to the body 304, such as via one or more fasteners 338 (e.g., bolts) extending through the knife 322 and the body 304, and may remain fixed during the cutting operations. The knife 322 may be fixed in position via other means, such as a shoulder extending into the passage 336.

The knife 320 may comprise a channel 340 configured to accommodate the conveyance line 120 therethrough, such that the knife 320 extends around the conveyance line 120 on three of the four sides of the conveyance line 120. The knife 322 may comprise a channel 342 configured to accommodate the conveyance line 120 therethrough, such that the knife 322 extends around the conveyance line 120 on three of the four sides of the conveyance line 120. Each channel 340, 342 may have a trough defined by or comprising a cutting edge of a corresponding knife 320, 322. The channels 340, 342 (or radial openings of the channels) may each be oriented in an opposing direction, such that the cutting edges of the knives 320, 322 collectively define or form a passage (or an opening) configured to accommodate the conveyance line 120 when the cutter 300 is connected to (i.e., assembled around) the conveyance line 120. For example, the channel 340 may extend along or parallel with respect to the conveyance line 120 and laterally (or perpendicularly) with respect to the conveyance line 120 in a first lateral direction. The channel 342 may extend along or parallel with respect to the conveyance line 120 and laterally (or perpendicularly) with respect to the conveyance line 120 in a second lateral direction. The first and second lateral directions are opposite from each other, thereby forming the passage configured to accommodate the conveyance line 120. The channels 340, 342 may each have a U-shaped axial profile, collectively forming or defining a circular or oval axial or otherwise longitudinal passage configured to accommodate the conveyance line 120. When the cutter 200 is connected with the conveyance line 120, the conveyance line 120 may be held or otherwise constrained within the passage defined by the channels 340, 342 of the knives 320, 322.

The cutting section 302 may further comprise a lever arm 324 pivotably connected with the body 304 via a pivot pin 326. The lever arm 324 may be located within a cavity 323 extending into and longitudinally along the body 304 and coinciding with at least a portion of the channel 306. The fluid pistons 312 may be disposed against one end 330 of the arm 324 and the knife 320 may be disposed against an opposing end 332 of the arm 324. The arm 324 may be configured to transfer force generated by the pistons 312 to the knife 274, such that movement of the pistons 312 in one direction causes the arm 324 to move the knife 320 in an opposing direction. The fluid chambers 314 and pistons 312 may be located on opposing sides of the channel 306 and the conveyance line 120 disposed within the channel 306 between the fluid chambers 314 and pistons 312. Accordingly, the pistons 312 may be disposed against the end 330 of the arm 324 at multiple locations along the arm 324. The fluid chambers 314 and pistons 312 may be arranged in two, four, or more rows, each located on an opposing side of the channel 306 and comprising one, two, three, four, or more fluid chambers 314 and corresponding pistons 312. FIG. 4 shows an outline of the knife 320 to prevent obstruction of view of the conveyance line 120, and an outline of the lever arm 324 and the pivot pin 326 to prevent obstruction of view of the conveyance line 120, the pistons 312, and the knives 320, 322.

One or more stop brackets 344 may be used to limit movement of the lever arm 324 caused by the pistons 312. Each stop bracket 344 may comprise a shoulder 346 extending over the end 330 of the lever arm 324 and mechanically stop outward movement of the lever arm 324 caused by the pistons 312. The stop brackets 344 may be separate and distinct members configured to be fixedly connected to the body 304 via one or more fasteners (not shown), such as threaded bolts. The brackets 344 may form a portion of or be located on opposing sides of the channel 306, thereby permitting the conveyance line 120 to be received into the channel 306 while the brackets 344 are attached to the body 304. FIG. 4 shows an outline of the brackets 344 to prevent obstruction of view of the fluid conduit 316.

The fluid actuators may further comprise a fluid piston 348 (or ram) slidably disposed within a corresponding fluid chamber 350 (or cylinder) within the body 304. The fluid chamber 350 may be fluidly connected with the fluid pump 248 via the fluid conduit 316. The cutting section 302 may further comprise a movable clamping member 352 pivotably connected with the body 304 via a pivot pin 354. The piston 278 may be mechanically or otherwise operatively connected to the clamping member 352 via a connecting member 356 (e.g., a shaft, a link, an arm, etc.), such that movement of the piston 348 imparts torque to the clamping member 352 thereby causing the clamping member 352 to pivot (or rotate) about the pivot pin 354. The clamping member 352 and at least a portion of the connecting member 356 may be located within a chamber 355 located within the body 304. The clamping member 352 may be or comprise an eccentric member (e.g., a cam) configured to extend laterally toward the conveyance line 120 and then engage the conveyance line 120 when pivoted. The clamping member 352 may have a circular, oval, pear-shaped, elliptical, or snail/drop profile, among other examples. The clamping member 352 may be temporarily locked or otherwise fixed in position with respect to the body 304 via a shear pin 353 extending through the clamping member 352 and the body 304. The shear pin 352 may maintain the clamping member 352 in a fixed position before the cutting operations, such as during downhole conveyance.

During the cutting operations, the clamping member 352 may be pivoted between a normal position, in which the clamping member 352 does not contact or otherwise engage the conveyance line 120, and an engaged position, in which at least a portion of the clamping member 352 compresses or otherwise engages the conveyance line 120 to grip the conveyance line 120, thereby connecting the cutter 300 to the conveyance line 120. In its engaged position, the clamping member 352 may push the conveyance line 120 against a static clamping member 358 (e.g., a backing plate), resulting in friction between the conveyance line 120, the clamping member 352, and the clamping member 358. The clamping member 358 may therefore grip the conveyance line 120 to further facilitate the connection of the cutter 300 to the conveyance line 120. The clamping member 358 may be a separate and distinct member configured to be selectively disposed within a corresponding cavity extending within the body 304 along the channel 306 and against (e.g., adjacent to) the conveyance line 120 located within the channel 306. The clamping member 358 may be fixedly connected to the body 304 via one or more fasteners (not shown), such as threaded bolts. The fluid chamber 350, the fluid piston 348, the clamping member 352, the connecting member 356, and the clamping member 358 may collectively form a clamping mechanism operable to connect the cutter 300 to the conveyance line 120. FIG. 4 shows an outline of the clamping member 358 to prevent obstruction of view of the fluid conduit 316 and portions of the clamping mechanism.

The cutting section 302 may further comprise a plurality of lower wheels 360 rotatably connected with the body 304, wherein the wheels 360 are operable to reduce friction between the cutter 300 and the surface (i.e., the sidewall) of the wellbore 102 (e.g., the fluid conduit 107) to facilitate downhole conveyance of the cutter 300 along the conveyance line 120. Each wheel 360 may be rotatably connected to the body 304 via an axle 362 (e.g., a hub, a spindle, a trunnion, etc.) extending from and fixedly connected to the body 304. Each axle 362 may be integrally formed with the body 304 or each axle 362 may be fixedly coupled with the body 304 via the one or more fasteners 364 (e.g., bolts) extending between the axle 362 and the body 304. Each axle 362 may be located within and extend from a recess 366 (e.g., a cavity) in the body 304, such that each wheel 360 is at least partially disposed within a corresponding recess 366, thereby reducing the width and the axial profile of the cutter 300. Although the cutter 300 is shown comprising the wheels 360, it is to be understood that the cutter 300 may be conveyed within the wellbore 102 with no wheels 360. For example, determining whether to install the wheels 360 may be based on downhole conditions, such as wellbore diameter, wellbore depth, and/or wellbore inclination.

A lower end of the body 304 may be tapered, forming a nose section 368 of the cutter 300. The nose section 368 may terminate with the bumper 305. The nose section 368 may further comprise a lower conveyance line retaining block or another member 370 ("retainer") configured to be connected with the body 304 to maintain or otherwise retain the conveyance line 120 within the channel 306, and thus maintain the cutter 300 slidably connected with the conveyance line 120. The retainer 370 may be a separate and distinct member configured to be selectively disposed within a corresponding cavity 372 extending within the body 304 along the channel 306 and against the conveyance line 120 located within the channel 306. The retainer 370 may be fixedly connected to the body 306 via one or more fasteners (not shown), such as threaded bolts. FIG. 4 shows an outline of the retainer 370 to prevent obstruction of view of the conveyance line 120 and the fasteners 338.

Figure 7:
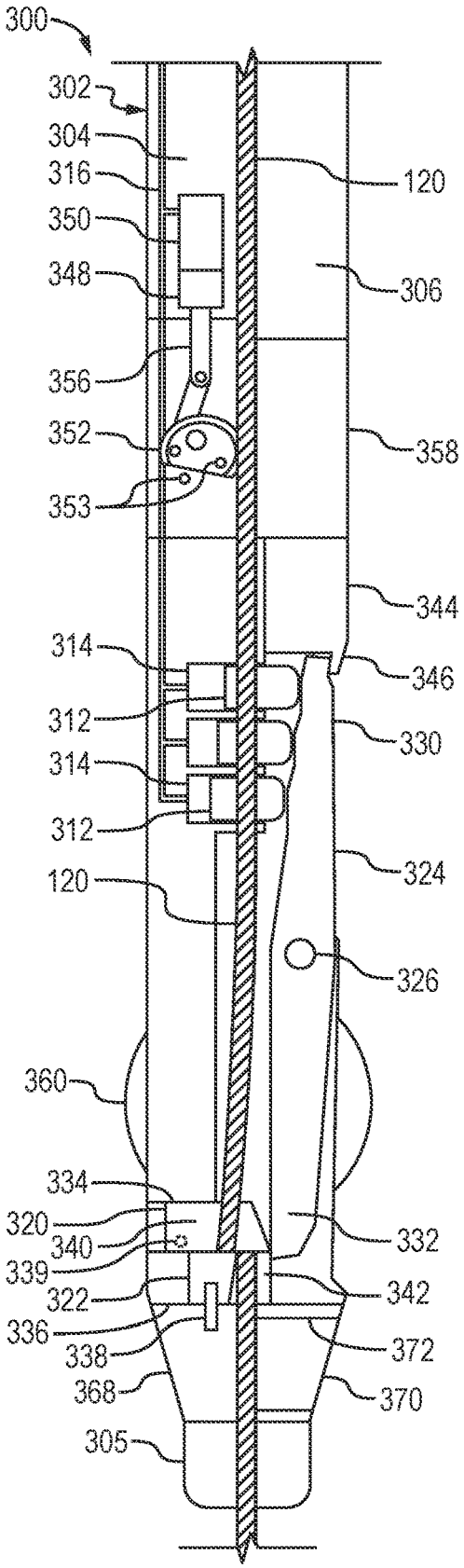
FIG. 7 is a schematic sectional view of the apparatus shown in FIG. 3 in a different stage of cutting operations.

The present disclosure is further directed to methods (e.g., operations or processes) of assembling and operating a cutter according to one or more aspects of the present disclosure, such as one of the cutters 114, 200, 300 shown in FIGS. 1-4. FIGS. 5 and 6 are axial views of the cutter 300 shown in FIGS. 3 and 4 during different stages of assembly operations. FIG. 7 is a schematic sectional view of the cutter 300 shown in FIGS. 3 and 4 during the cutting operations. Accordingly, the following description refers to FIGS. 1-7, collectively.

When it is intended to convey the cutter 300 downhole along a wellbore 102 to cut a conveyance line 120 of a tool string 110, such as when the tool string 110 is stuck within the wellbore 102 and the conveyance line 120 cannot be otherwise disconnected from the tool string 110, the cutter 300 may be inserted over or otherwise disposed onto the conveyance line 120 at a wellsite surface 104, such that the conveyance line 120 is disposed within the channel 306. As shown in FIGS. 2 and 5, the cutter 300 may be disposed onto the conveyance line 120 when the lower retainer 370, the upper retainer 222, the clamping member 358, the lever arm 324, the pivot pin 326, and the knife 320 are removed from the body 304, resulting in the channel 306 being unobstructed, thereby permitting the cutter 300 to be disposed onto the conveyance line 120 such that the conveyance line 120 is located within the channel 306 and the channel 342 of the knife 322. As shown in FIGS. 2-4 and 6, the lower retainer 370 and the upper retainer 222 may be inserted within the corresponding cavities 372, 226 to retain the conveyance line 120 within the channel 306, thereby slidably connecting the cutter 300 to the conveyance line 120. The knife 320 may be inserted into the passage 334 such that the conveyance line 120 is disposed within the channel 340 of the knife 320. The lever arm 324 may then be inserted into the cavity 323 such that the upper end 330 is disposed against the pistons 312 and the lower end 332 is disposed against the knife 320. The lever arm 324 may then be pivotably connected to the body 304 via the pivot pin 326. The stop brackets 344 and the clamping member 358 may be coupled to the body 304.

The cutter 300 may also comprise one or more cups 325, each having a substantially circular axial profile, and extending radially away from and circumferentially around the body of the cutter 300. The outer diameter of the cups 325 may be larger than an outer diameter of the wheels 360. The axial profile or circumference of the cups 325 may be smaller than the axial profile of the wheels 360, and thus not encompass the axial profile of the wheels 360. Each cup 325 may comprise a channel 327 (or slot) extending radially on one side of the cup 325. Accordingly, the cups 325 extend circumferentially around most, but not all, of the body of the cutter 300. The channels 327 may be aligned with the channel 306, such as may permit the conveyance line 120 to be received into the channel 306.

Before or after the cutter 300 is connected to the conveyance line 120, a human operator may operate the input device 234 to activate the cutter 300 and/or set an operational mode of the cutter 300. For example, the human operator may operate the input device 234 to set an intended time delay for the controller 232 to initiate the cutting operations of the cutter 300. The output device 236 may confirm or otherwise visually indicate to the human operator the mode of operation (e.g., the time delay) to which the controller 232 was set. The plug 240 may then be connected with the body 228 to fluidly seal the cavity 238. The cutter 300 may then be conveyed downhole along the wellbore 102 until the cutter reaches (i.e., contacts) the tool string 110.

After the time delay set in the controller 232 by the human operator is reached, the controller 232 may power or otherwise operate the electric motor 250 thereby causing the pump 248 to draw the power fluid from the fluid reservoir 242 and discharge (i.e., pump) the power fluid into the fluid conduit 316. The pressurized power fluid is then passed along the fluid conduit 316 to the fluid chamber 350 of the clamping mechanism and the fluid chambers 314 of the cutting mechanism, thereby urging the corresponding pistons 348, 312 to extend. The shear pin 353 may be configured to break under the shear stress generated by the fluid piston 348 before the shear pin 339 breaks under the shear stress generated by the pistons 312. Accordingly, the clamping member 352 can pivot to engage the conveyance line 120 to connect the cutter 300 to the conveyance line 120 before the knife 320 can move to cut the conveyance line 120.

As further shown in FIG. 7, after the clamping member 352 engages the conveyance line 120, fluid pressure within the fluid conduit 316 and the fluid chambers 314 increases, causing the pistons 312 to apply an increasing force to the lever arm 324 and to the knife 320. After sufficient fluid pressure is reached, the shear pin 339 breaks, thereby permitting the knife 320 to move along the channel 334. While the pump 248 injects the pressurized power fluid into the fluid chambers 314 via the fluid conduit 316, the knife 320 continues to move along the channel 334 causing the cutting edges of the knives 320, 322 to progressively cut the conveyance line 120 until the conveyance line 120 is completely cut (i.e., severed). After the conveyance line 120 is completely cut, the weight of the downhole tool is transferred to the conveyance line 120 imparting tension to the conveyance line 120. Such tension imparts torque to the clamping member 352 thereby causing the clamping member 352 to maintain engagement with the conveyance line 120. The clamping member 352 may thus be or operate as a cam lock gripper operable to grip the conveyance line 120 when the conveyance line 120 is under tension even when the piston 350 is not imparting torque to the clamping member 352. Additional tension may then be applied to the conveyance line 120 from the wellsite surface 104 via one or more of the conveyance devices 140, 144 to retrieve the conveyance line 120 and the cutter 300 to the surface 104.

Figure 8:
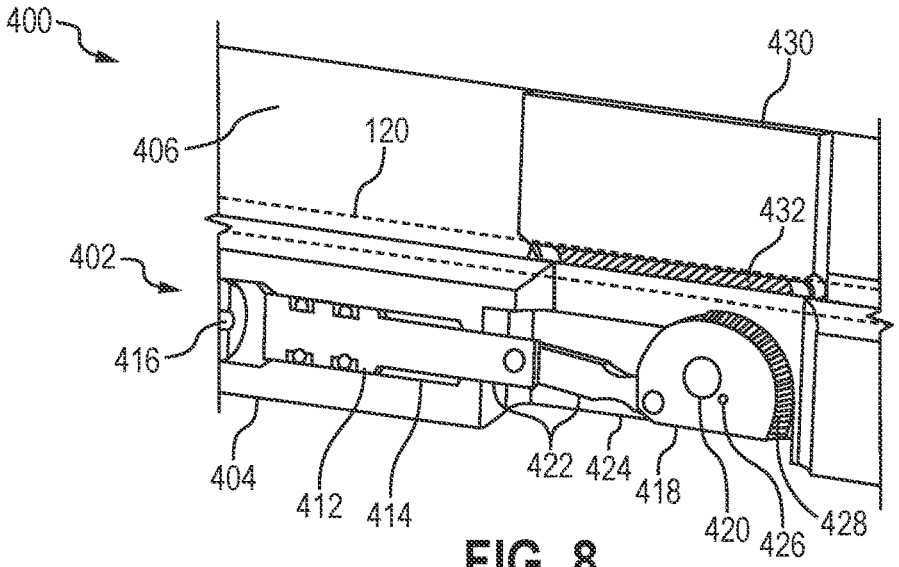
FIGS. 8-10 are perspective sectional views of a portion of an example implementation of apparatus according to one or more aspects of the present disclosure in different stages of clamping operations.
Figure 9:
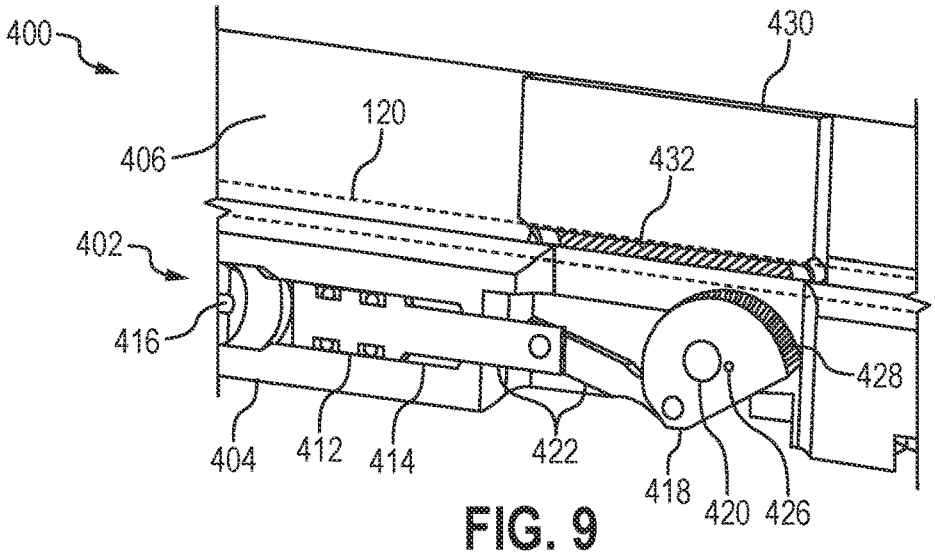
Figure 10:
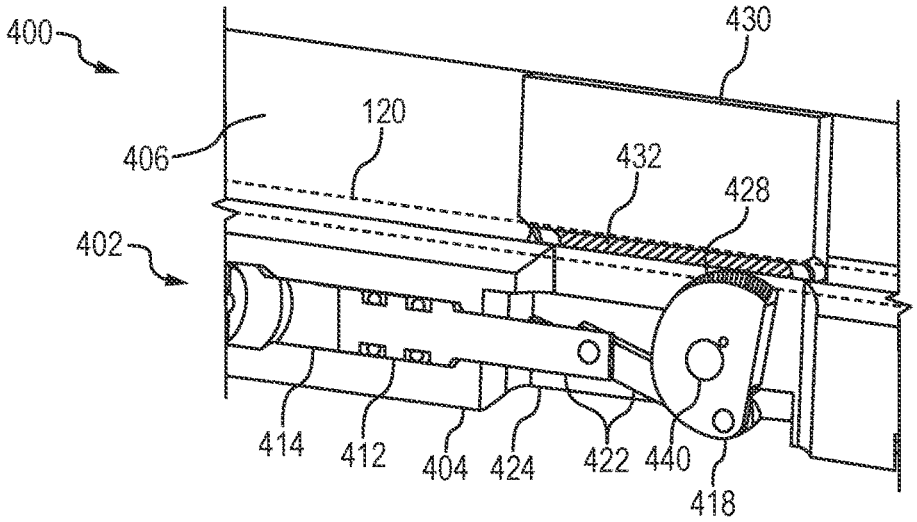

FIGS. 8-10 are perspective sectional views of a portion of a cutter 400 during different stages of cutting operations. Namely, FIGS. 8-10 show at least a portion of a clamping mechanism 402 of the cutter 400 during different stages of a clamping portion of the cutting operations. The cutter 400 may comprise one or more features of the cutters 114, 200, 300 described above and shown in FIG. 1-7. The following description refers to FIGS. 1, 2, and 8-10, collectively.

The clamping mechanism 402 may comprise a fluid piston 412 (or ram) slidably disposed within a corresponding fluid chamber 414 (or cylinder) within a body 404 of the cutter 400. The fluid chamber 414 may be fluidly connected with a fluid pump 248 via a fluid conduit 416. The clamping mechanism 402 may further comprise a movable clamping member 418 pivotably connected with the body 404 via a pivot pin 420. The piston 412 may be mechanically or otherwise operatively connected to the clamping member 418 via a connecting member 422 (e.g., a shaft, a link, an arm, etc.), such that movement of the piston 412 imparts torque to the clamping member 418, thereby causing the clamping member 418 to pivot (or rotate) about the pivot pin 420. The clamping member 418 and at least a portion of the connecting member 422 may be located within a chamber 424 located within the body 404. The clamping member 418 may be or comprise an eccentric member (e.g., a cam) configured to extend laterally toward a conveyance line 120 (shown in phantom lines) when pivoted to engage the conveyance line 120. The conveyance line 120 is shown located at the bottom (i.e., the trough) of a channel 406 extending through or along the cutter 400. The clamping member 418 may have a circular, an oval, a pear-shaped, an elliptical, or a snail-drop profile, among other examples. The clamping member 418 may comprise a channel or another concave outer surface 428 configured to extend partially around or otherwise accommodate an outer surface of one side of the conveyance line 120. The concave outer surface 428 may be textured (e.g., comprising ridges, ribs, or teeth) to facilitate gripping of or friction against the conveyance line 120. The clamping member 418 may be temporarily locked or otherwise fixed in position with respect to the body 404 via a shear pin 426 extending through the clamping member 418 and the body 404. The shear pin 426 may maintain the clamping member 418 in a fixed position at a distance from the conveyance line 120 before the clamping operations, such as during downhole conveyance.

During the clamping operations, the clamping member 418 may be pivoted (or rotated) by the piston 412 when a power fluid is pumped into the fluid chamber 414 by the pump 248. The clamping member 418 may be pivoted from a normal position, shown in FIG. 8, in which the clamping member 418 does not contact or otherwise engage the conveyance line 120, to an intermediate position, shown in FIG. 9, in which a portion of the clamping member 418 approaches the conveyance line 120, and then to an engaged position, shown in FIG. 10, in which a portion of the clamping member 418 compresses or otherwise engages the conveyance line 120 to grip the conveyance line 120 and thereby connect the cutter 400 to the conveyance line 120. In the engaged position, the clamping member 418 may compress the conveyance line 120 against a static clamping member 430 (e.g., a backing plate) of the body 406, resulting in friction between the conveyance line 120, the clamping member 418, and the clamping member 430 such that the compressed portion of the conveyance line 120 is inhibited from moving with respect to the clamping members 418, 430.

The clamping member 430 may comprise a channel or another concave surface 432 configured to extend partially around or otherwise accommodate the outer surface of one side of the conveyance line 120. The concave surface 432 may be textured (e.g., comprise ridges, ribs, or teeth) to facilitate gripping of or friction against the conveyance line 120. The clamping member 430 may thus grip the conveyance line 120 to further facilitate the connection of the cutter 400 to the conveyance line 120. The clamping member 430 may be a separate and distinct member from the body 404 and configured to be selectively disposed within a corresponding cavity extending within the body 404 along the channel 406 and against (e.g., adjacent to) the conveyance line 120 located within the channel 406. The clamping member 430 may be fixedly connected to the body 404 via one or more fasteners (not shown), such as threaded bolts.

The clamping member 418 may be configured to compress the conveyance line 120, causing an increased clamping force of the clamping members 418, 430 against the conveyance line 120 when the conveyance line 120 is pulled upward with respect to the body 404 after the conveyance line 120 is cut. The clamping member 418 may thus be or operate as a cam lock gripper operable to grip the conveyance line 120 when the conveyance line 120 is under tension even when the piston 412 is not imparting torque to the clamping member 418. Thus, the clamping members 418, 430 can grip and hold the conveyance line 120 to maintain connection between the conveyance line 120 and the cutter 400 when pressure of the fluid applied to the piston 412 is absent, lost, or otherwise decreases.

Figure 11:
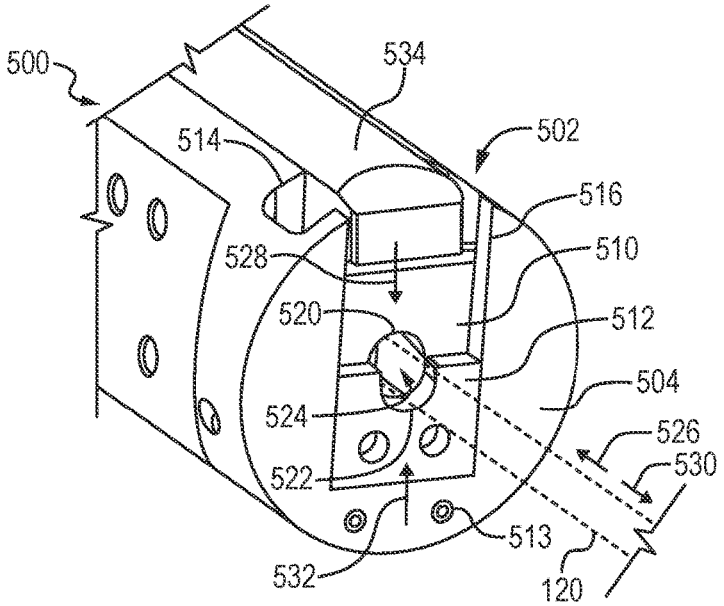
FIGS. 11-13 are perspective sectional views of a portion of an example implementation of apparatus according to one or more aspects of the present disclosure in different stages of cutting operations.
Figure 12:
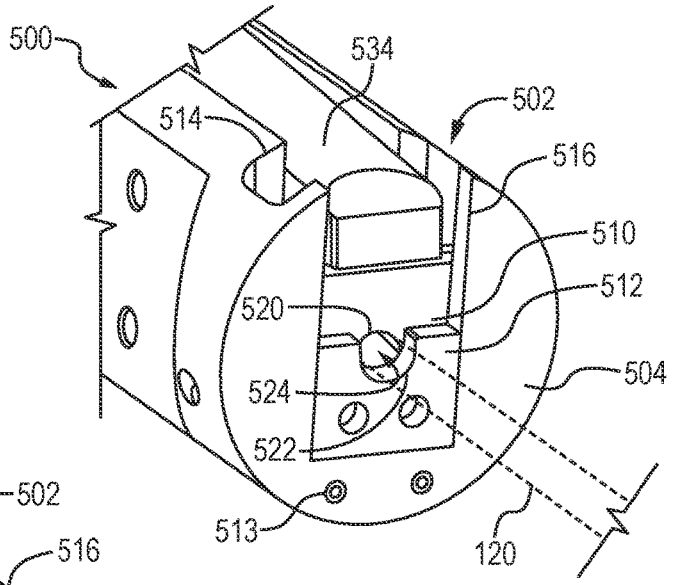
Figure 13:
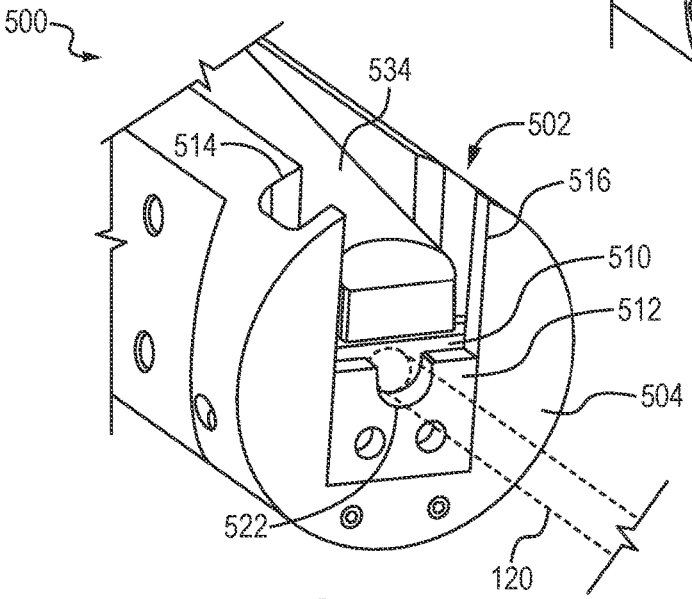

FIGS. 11-13 are perspective sectional views of a portion of a cutter 500 during different stages of cutting operations. Namely, FIGS. 11-13 show a portion of a cutting mechanism 502 of the cutter 500 during different stages of a cutting portion of the cutting operations. The cutter 500 may comprise one or more features of the cutters 114, 200, 300, 400 described above and shown in FIG. 1-10. The following description refers to FIGS. 1, 2, and 11-13, collectively.

The cutting mechanism 502 may comprise knives 510, 512 configured to cut the conveyance line 120 (shown in phantom lines) during the cutting operations. The knife 510 may be movable within or otherwise with respect to a body 504 of the cutter 500, and the knife 512 may be fixedly disposed (i.e., static) within or otherwise with respect to the body 504. For example, the knife 510 may be slidably disposed within a passage 514 (or bore) extending through the body 504 laterally (or perpendicularly) with respect to the conveyance line 120. The knife 512 may be disposed within a passage 516 (or bore) extending through the body 504 laterally (or perpendicularly) with respect to the conveyance line 120. The knife 510 may be temporarily locked or otherwise fixed in position with respect to the body 504 via a shear pin 513 extending through the knife 510 and/or the body 504. The shear pin 513 may maintain the knife 510 in a fixed position before the cutting operations, such as during downhole conveyance. The knife 512 may be locked or otherwise fixed in position with respect to the body 504 via one or more fasteners (not shown) extending through the knife 512 and the body 504. The knife 510 may be movable with respect to the body 504 and the knife 512 during the cutting operations, and the knife 512 may remain fixed with respect to the body 504 during the cutting operations. The knife 510 may comprise a channel 520 configured to accommodate the conveyance line 120 therethrough, such that the knife 510 extends around the conveyance line 120 on three of the four sides of the conveyance line 120. The knife 512 may comprise a channel 522 configured to accommodate the conveyance line 120 therethrough, such that the knife 512 extends around the conveyance line 120 on three of the four sides of the conveyance line 120. Each channel 520, 522 may have a trough defined by or comprising a cutting edge of a corresponding knife 510, 512. The channels 520, 522 may each be oriented in an opposing direction, such that the cutting edges of the knives 510, 512 collectively define or form a passage 524 (or an opening) configured to accommodate the conveyance line 120 when the cutter 500 is connected to (i.e., assembled around) the conveyance line 120. When the cutter 500 is connected to the conveyance line 120, the channel 520 may extend along or parallel to the conveyance line 120, as indicated by arrow 526, and laterally (or perpendicularly) with respect to the conveyance line 120 in a first lateral direction, as indicated by arrow 528. The channel 522 may extend along or parallel with respect to the conveyance line 120, as indicated by arrow 530, and laterally (or perpendicularly) with respect to the conveyance line 120 in a second lateral direction, as indicated by arrow 532. The first and second lateral directions 528, 532 are opposite from each other. The channels 520, 522 may each have a U-shaped axial profile, collectively forming or defining a circular or oval axial or otherwise longitudinal passage 524 configured to accommodate the conveyance line 120. When the cutter 500 is connected with the conveyance line 120, the conveyance line 120 may be held or otherwise constrained within the passage 524 defined by the channels 520, 522 of the knives 510, 512.

During the cutting operations, a pivot arm 534 may be pivoted by one or more fluid pistons 266 when a power fluid is pumped into fluid chambers 268 containing the pistons 266 by a pump 248. The pivot arm 534 may then push the knife 510 from a normal position, shown in FIG. 11, in which the knife 510 does not contact or otherwise engage the conveyance line 120, to an intermediate position, shown in FIG. 12, in which the knife 510 moves within the passage 514 against the conveyance line 120, pushing the conveyance line against the knife 512. While the pivot arm 534 continues to move the knife 510 with respect to the knife 512, the cutting edges of the knives 510, 512 cut the conveyance line 120 while the sides of the channels 520, 522 prevent, inhibit, or otherwise reduce flattening of the conveyance line 120 between the knives 510, 512. The pivot arm 534 may then push the knife 510 to a cut position, shown in FIG. 13, in which the opening 524 is fully closed and the conveyance line 120 is fully cut (i.e., severed).

Figure 14:
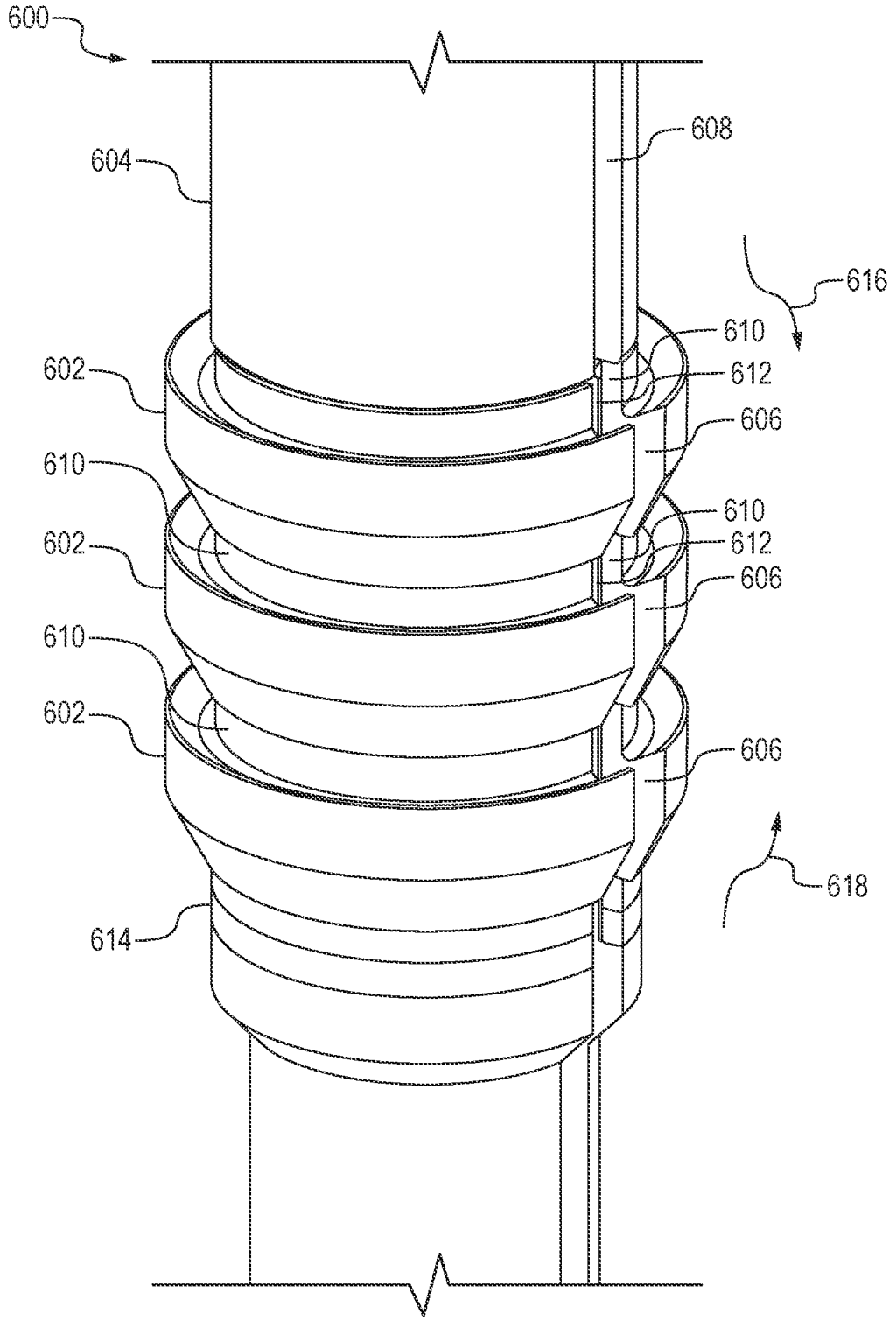
FIG. 14 is a perspective view of a portion of an example implementation of apparatus according to one or more aspects of the present disclosure.

FIG. 14 is a perspective view of a portion of an example implementation of a cutter 600 according to one or more aspects of the present disclosure. The cutter 600 comprises an example implementation of cups 602 connected with a body 604 of the cutter 600 to aid or otherwise facilitate downhole conveyance of the cutter 600. The cutter 600 may comprise one or more features of the cutters 114, 200, 300, 400, 500 described above and shown in FIG. 1-13. The following description refers to FIGS. 1, 2, and 14, collectively.

Each cup 602 may be or comprise a swab cup extending radially away from the body 604 and circumferentially around the body 604, thereby increasing an axial profile and axial surface area of the cutter 600. Each cup 602 may have a substantially circular axial profile. Each cup 602 may comprise a channel 606 (or slot) extending radially and axially on one side of the cup 602. Accordingly, the cups 602 extend circumferentially around most, but not all, of the body 604. The channels 227 may be aligned with a channel 608 of the cutter 600, such as may permit the conveyance line 120 to be received into the channel 608. A radially inner portion 610 of each cup 602 may be disposed within a channel 612 extending circumferentially along an outer surface of the body 604 to maintain the cups 602 in axial position with respect to or along the body 604. One or more retaining rings 614 may prevent the cups 602 from sliding axially within the channel 612.

The cups 602 permit the cutter 600 to be pumped downhole with increased efficiency. For example, a fluid (e.g., water) may be pumped into the wellbore 102 behind (uphole from) the cutter 600 to increase pressure behind the cutter 600, thereby forming a pressure differential across the cutter 600 that pushes the cutter 600 downhole along the wellbore 102. The cups 602 may decrease downhole flow rate of the pumped fluid flowing around and past the cutter 600, as indicated by arrow 616, thereby permitting a higher pressure differential to be maintained across the cutter 600. The cups 602 may also or instead increase friction of the passing fluid against the cutter 600, therefore increasing drag or friction forces of the passing fluid against the cutter 600. The cups 602 may also operate to decrease rate of descent of the cutter 600 along vertical or near-vertical portions of the wellbore 102. For example, the cups 602 may operate as a drogue, increasing axial surface area of the cutter 600 to increase drag or friction forces against the sidewall of the wellbore 102 and/or against wellbore fluid within the wellbore 102, thereby decreasing the rate of descent of the cutter 600. The cups 602 may also decrease flow rate of the wellbore fluid flowing around and past the cutter 600, as indicated by arrow 618, while the cutter 600 descends downhole to maintain or otherwise facilitate a higher pressure in front of (downhole from) the cutter 600, thereby decreasing the rate of descent of the cutter 600.

Figure 15:
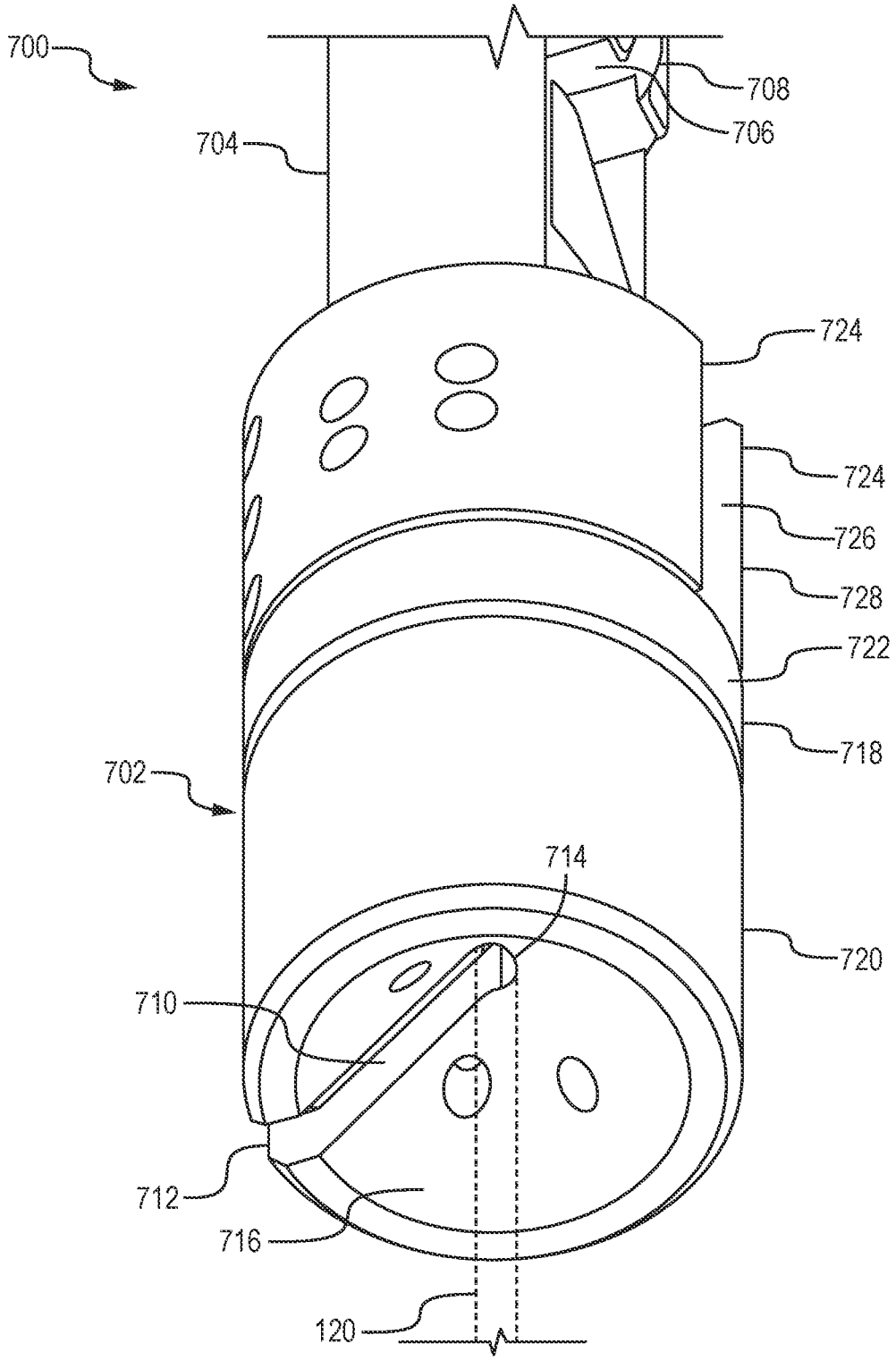
FIG. 15 is a perspective view of a portion of an example implementation of apparatus according to one or more aspects of the present disclosure.
Figure 16:
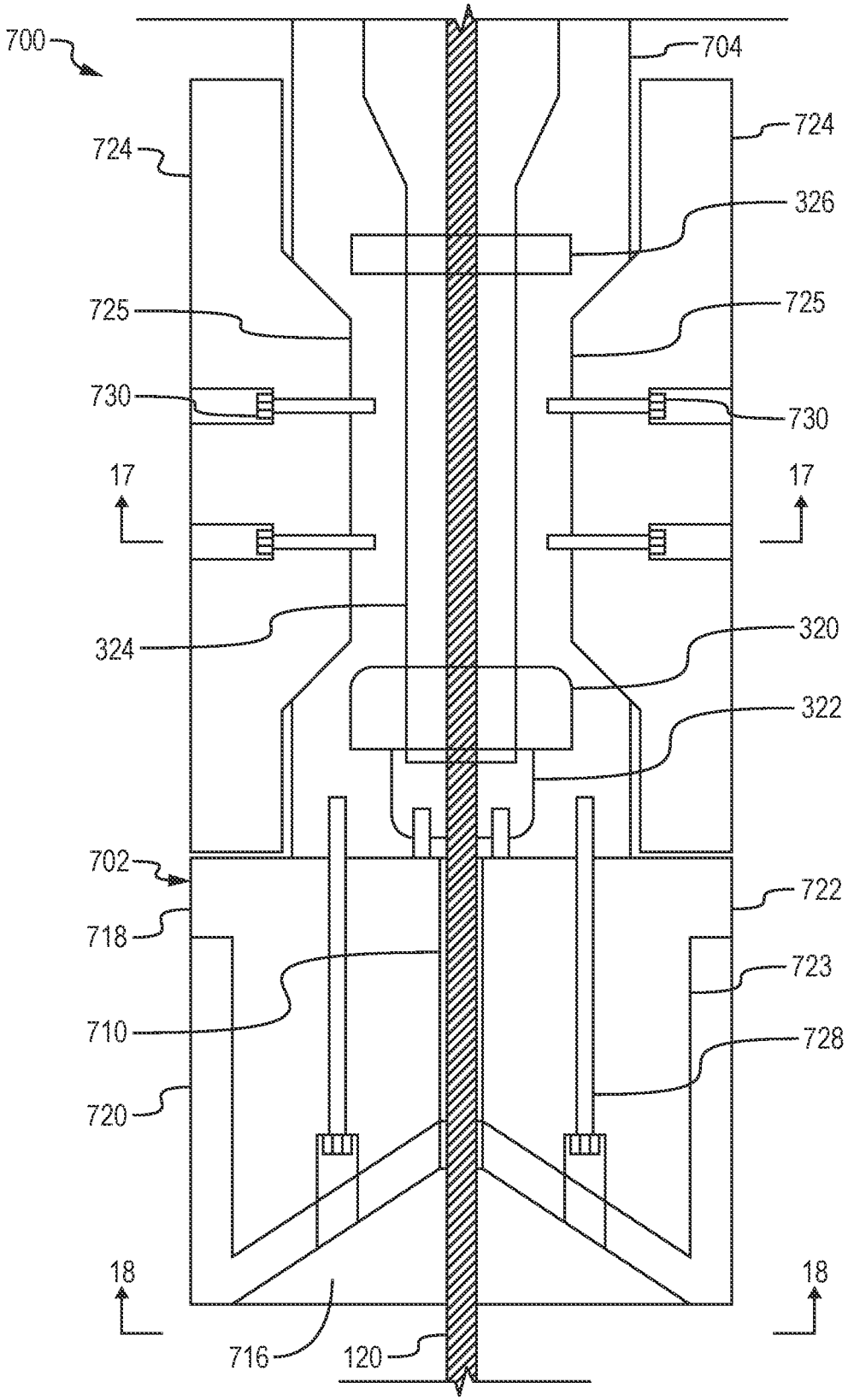
FIG. 16 is a schematic sectional view of a portion of an example implementation of apparatus according to one or more aspects of the present disclosure.
Figure 17:
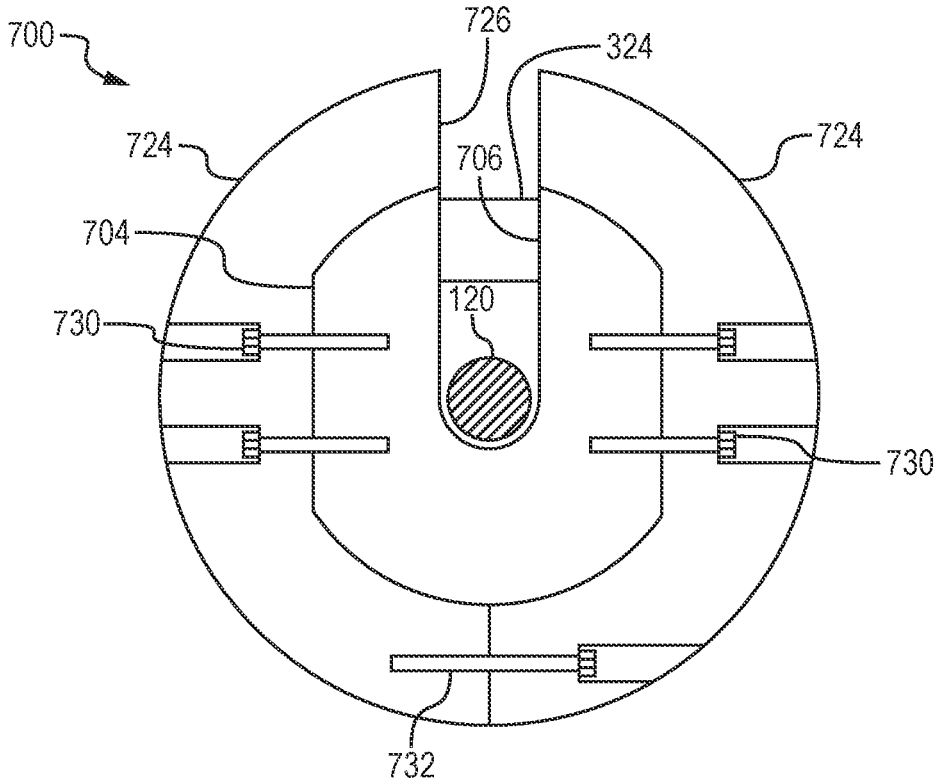
FIG. 17 is a sectional view of the apparatus shown in FIG. 16.
Figure 18:
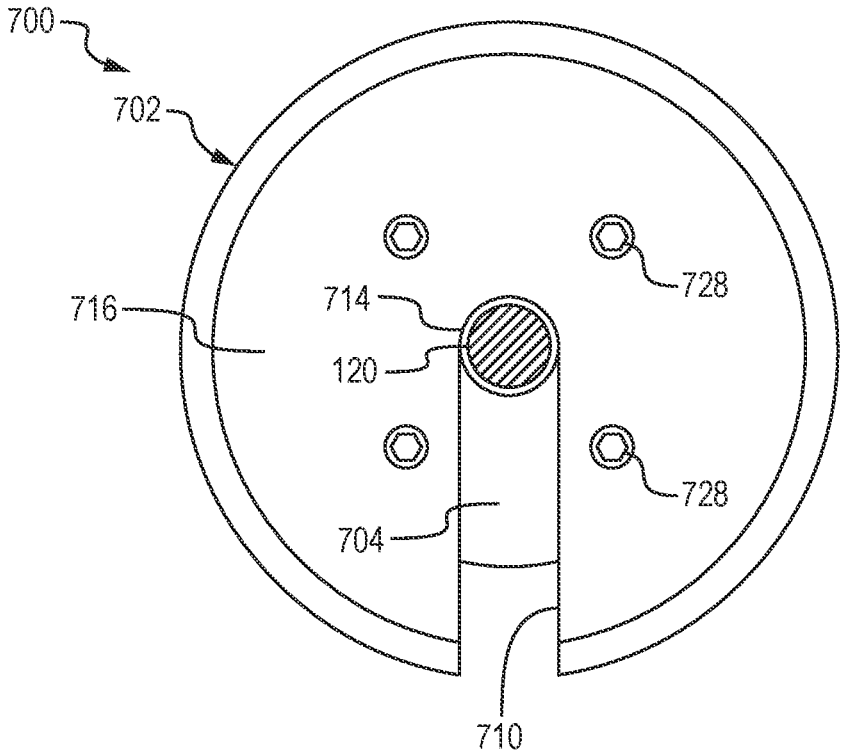
FIG. 18 is an axial view of the apparatus shown in FIG. 16.

FIG. 15 is a perspective view of a portion of an example implementation of a cutter 700 according to one or more aspects of the present disclosure. FIG. 16 is a schematic sectional view of a portion of an example implementation of the cutter 700 shown in FIG. 15. FIG. 16 shows outlines of selected features of the cutter 700 to prevent obstruction of view of other features of the cutter 700. FIGS. 17 and 18 are sectional and axial views, respectively, of the cutter 700 shown in FIG. 16. The cutter 700 may comprise one or more features of the cutters 114, 200, 300, 400, 500, 600 described above and shown in FIG. 1-14, including where referred to by the same reference numerals. The following description refers to FIGS. 1, 4, and 15-18, collectively.

The cutter 700 may comprise a nose section 702 at a lower end of the cutter 700. The nose section 702 may be detachably connected with a lower end of a body 704 of the cutter 700. The body 704 may be or comprise the body 304 of the cutting section 302 shown in FIG. 4. The nose section 702 may be detachably connected with the body 704 via a plurality of fasteners 728 extending between the nose section 702 and the body 704. The fasteners 728 may be or comprise a plurality of bolts extending through the nose section 702 and into the body 704 to threadedly connect the nose section 702 to the body 704. The nose section 702 may be configured to contact an upper end of a tool string 110 conveyed via a conveyance line 120. The nose section 702 may comprise an outer diameter that is larger than an outer diameter of the body 704. The nose section 702 may be a selected one of a plurality (e.g., a kit) of nose sections, each comprising a different outer diameter. The nose section 702 may be selected from the plurality of nose sections based on an inner diameter of the wellbore 102 (e.g., the fluid conduit 107, the casing 108 if the fluid conduit 107 is not installed, or the open-hole wellbore if the casing 108 and conduit 107 are not installed) in which the cutter 700 is to be conveyed, for example, such that the outer diameter of the nose section 702 closely matches (i.e., is slightly smaller than) the inner diameter of the wellbore 102. For example, the outer diameter of the nose section 702 may be less than about 10%, 15%, or 20% smaller than the inner diameter of the wellbore 102.

The body 704 may define or otherwise comprise a channel 706 (or slot) extending radially on one side of the body 704 to an outer surface of the body 704, and longitudinally (e.g., axially) through or along the body 704 between opposing upper and lower ends of the body 704. The channel 706 may accommodate the conveyance line 120 therethrough. The channel 706 may comprise a radial opening 708 configured to receive the conveyance line 120 into the channel 706. The nose section 702 may define or otherwise comprise a channel 710 (or slot) extending radially on one side of the nose section 702 to an outer surface of the nose section 702, and longitudinally (e.g., axially) through or along the nose section 702 between opposing upper and lower ends of the nose section 702. The channel 710 may accommodate the conveyance line 120 therethrough. The channel 710 may comprise a radial opening 712 configured to receive the conveyance line 120 into the channel 710. Each channel 706, 710 may have a generally U-shaped axial profile. The radial opening 712, and thus the channel 710, may be azimuthally (i.e., angularly) misaligned with respect to the radial opening 708, and thus the channel 706, to maintain or otherwise retain the conveyance line 120 within the channel 706, and thus maintain the cutter 700 slidably connected with the conveyance line 120. The channels 706, 710 may collectively form or define an axial or otherwise longitudinal passage 714 configured to accommodate the conveyance line 120 therethrough when the nose section 702 is connected with the body 704.

The nose section 702 may define or otherwise comprise a contact surface 716 configured to contact an upper end of the tool string 110 when the cutter 700 is conveyed downhole. The contact surface 716 may be a concave (e.g., inverted conical, bowl-shaped, etc.) surface configured to accommodate or otherwise receive the upper end of the tool string when the cutter 700 contacts the upper end of the tool string 110. The nose section 702 may comprise a generally cylindrical outer geometry. The nose section 702 may comprise a body 718 and a bumper sleeve 720 disposed about the body 718. The body 718 may have a larger outer diameter section 722 and a smaller outer diameter section 723. The bumper sleeve 720 may be disposed about the smaller outer diameter section 723 of the body 718. The bumper sleeve 720 may define or otherwise comprise the contact surface 716. The bumper sleeve 720 may comprise a flexible, malleable, or other material that is softer than the material forming the body 704 of the cutter 700 and/or the body 718 of the nose section 702. The bumper 720 may elastically flex or yield (i.e., deform) to absorb impact energy and reduce the shock to the cutter 700 and the tool string 110, and thus prevent or inhibit damage to the cutter 700 and the tool string when the cutter 700 reaches and contacts the tool string. The material forming the bumper sleeve 720 may be or comprise rubber, Viton, plastic, or another elastically flexible, malleable, or relatively softer material.

The nose section 702 may maintain the cutter 700 centered and stable while the cutter 700 is conveyed downhole along the conveyance line 120. The nose section 702 may prevent or inhibit the cutter 700 from passing the upper end of a stuck tool string 110 upon reaching the tool string 110 and becoming wedged between the tool string 110 and the sidewall of the wellbore 102. The nose section 702 may permit the cutter 700 to be pumped downhole with increased efficiency. For example, a fluid (e.g., water) may be pumped into the wellbore 102 behind (uphole from) the cutter 700 to increase pressure behind the cutter 700, thereby forming a pressure differential across the nose section 702 that pushes the cutter 700 downhole along the wellbore 102. The nose section 702 may decrease downhole flow rate of the pumped fluid flowing around and past the cutter 700, thereby permitting a higher pressure differential to be maintained across the cutter 700. The nose section 702 may increase friction of the passing fluid against the cutter 700, therefore increasing drag or friction forces of the passing fluid against the cutter 700. The nose section 702 may operate to decrease rate of descent of the cutter 700 along vertical or near-vertical portions of the wellbore 102. For example, the nose section 702 may operate as a drogue, increasing axial surface area of the cutter 700 to increase drag or friction forces against the sidewall of the wellbore 102 and/or against wellbore fluid within the wellbore 102, thereby decreasing the rate of descent of the cutter 700. The nose section 702 may decrease flow rate of the wellbore fluid flowing around and past the cutter 700 while the cutter 700 descends downhole to maintain or otherwise facilitate a higher pressure in front of (downhole from) the cutter 700, thereby decreasing the rate of descent of the cutter 700.

The cutter 700 may further comprise guide members 724 (or stabilizers) extending radially away from the body 704 of the cutter 700 and circumferentially around the body 704, thereby increasing an axial profile and axial surface area of the cutter 700. The guide members 724 may collectively have a substantially circular axial profile. The guide members 724 may be detachably connected to the body 704. Each guide member 724 may be located within and extend from a recess 725 (e.g., a cavity) in the body 704, such that each guide member 724 is at least partially disposed within a corresponding recess 725. The guide members 724 may be detachably connected with the body 704 via a plurality of fasteners 730 extending between the guide members 724 and the body 704. The fasteners 730 may be or comprise a plurality of bolts extending through the guide members 724 and into the body 704 to threadedly connect the guide members 724 to the body 704. Adjacent guide members 724 may be detachably connected together via a plurality of fasteners 732 extending therebetween. The fasteners 732 may be or comprise a plurality of bolts extending through the adjacent guide members 724 to threadedly connect the adjacent guide members 724.

Each guide member 724 may comprise an outer diameter that is larger than the outer diameter of the body 704. The guide members 724 may define a channel 726 (or slot) extending radially and longitudinally (e.g., axially) between the guide members 724. The channel 726 may accommodate the conveyance line 120 therethrough. The channel 726 may comprise a radial opening 728 configured to receive the conveyance line 120 into the channel 726. Accordingly, the guide members 724 may extend circumferentially around most, but not all, of the body 704. The radial opening 728, and thus the channel 726, may be azimuthally (i.e., angularly) aligned with respect to the radial opening 708, and thus the channel 706. The radial opening 728, and thus the channel 726, may be azimuthally (i.e., angularly) misaligned with respect to the radial opening 712, and thus the channel 710 of the nose section 702.

The guide members 724 may be a selected set of a plurality (e.g., a kit) of sets of guide members, each set comprising a different outer diameter. The guide members 724 may be selected from the plurality of sets of guide members based on an inner diameter of the wellbore 102 the cutter 700 is conveyed within, for example, such that the outer diameter of the selected guide members 724 closely match (e.g., is less than 10%, 15%, or 20% smaller than) the inner diameter of the wellbore 102. The guide members 724 may be selected from the plurality of sets of guide members based on the outer diameter of the nose section 702, for example, such that the outer diameter of the selected guide members 724 is substantially the same as the outer diameter of the nose section 702. The guide members 724 may help maintain the cutter 700 centered and stable while the cutter 700 is conveyed downhole along the conveyance line 120.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the scope of the present disclosure, and that they may make various changes, substitutions and alterations herein without departing from the spirit and scope of the present disclosure.

What is claimed is:

1. An apparatus comprising:

a downhole tool operable to be conveyed downhole within a wellbore along a conveyance line that conveys a tool string within the wellbore, connect to the conveyance line, and cut the conveyance line, wherein the downhole tool comprises:

a body;

a cutting member operable to cut the conveyance line; and a clamping mechanism comprising:

a clamping member pivotably connected with the body; and an actuator operable to pivot the clamping member to cause the clamping member to engage the conveyance line thereby connecting the downhole tool to the conveyance line such that the downhole tool can be retrieved out of the wellbore via the conveyance line after the downhole tool cuts the conveyance line.

2. The apparatus of claim 1 wherein the clamping member is a first clamping member, and wherein the first clamping member engages the conveyance line by compressing the conveyance line against a second clamping member to grip the conveyance line such that the conveyance line is inhibited from moving with respect to the first clamping member and the second clamping member thereby connecting the downhole tool to the conveyance line.

3. The apparatus of claim 2 wherein the first clamping member comprises a first channel configured to accommodate a first side of the conveyance line, and wherein the second clamping member comprises a second channel configured accommodate a second side of the conveyance line.

4. The apparatus of claim 2 wherein the first clamping member comprises a first textured surface configured to grip a first side of the conveyance line, and wherein the second clamping member comprises a second textured surface configured to grip a second side of the conveyance line.

5. The apparatus of claim 1 wherein the actuator is operable to impart torque to the clamping member to pivot the clamping member to cause the clamping member to engage the conveyance line by compressing the conveyance line to grip the conveyance line such that the conveyance line is inhibited from moving with respect to the clamping member thereby connecting the downhole tool to the conveyance line.

6. The apparatus of claim 5 wherein, when the downhole tool is connected to the conveyance line, the conveyance line is cut, and the conveyance line supports the weight of the downhole tool, tension in the conveyance line caused by the weight of the tool string also imparts torque to the clamping member thereby causing the clamping member to compress the conveyance line to grip the conveyance line such that the conveyance line is inhibited from moving with respect to the clamping member thereby maintaining connection of the downhole tool to the conveyance line.

7. The apparatus of claim 1 wherein the clamping member is or comprises a cam.

8. The apparatus of claim 1 wherein the actuator comprises:

a fluid chamber;

a piston slidably disposed within the fluid chamber;

a connecting member operatively connecting the piston and the clamping member; and the fluid source operable to move a fluid into the fluid chamber to cause the piston to move the connecting member and thereby pivot the clamping member to cause the clamping member to engage the conveyance line.

9. An apparatus comprising:

a downhole tool operable to be conveyed downhole within a wellbore along a conveyance line that conveys a tool string within the wellbore, connect to the conveyance line, and cut the conveyance line, wherein the downhole tool comprises:

a body;

a cutting member operable to cut the conveyance line; and a clamping member pivotably connected with the body, wherein the clamping member is operable to engage the conveyance line, and wherein, when the conveyance line is cut, tension in the conveyance line caused by the weight of the tool string imparts torque to the clamping member thereby causing the clamping member to compress the conveyance line to grip the conveyance line such that the conveyance line is inhibited from moving with respect to the clamping member thereby connecting the downhole tool to the conveyance line such that the downhole tool can be retrieved out of the wellbore via the conveyance line.

10. The apparatus of claim 9 wherein the clamping member is a first clamping member, and wherein, when the conveyance line is cut, tension in the conveyance line caused by the weight of the tool string imparts torque to the clamping member thereby causing the clamping member to compress the conveyance line against a second clamping member to grip the conveyance line such that the conveyance line is inhibited from moving with respect to the first clamping member and the second clamping member thereby connecting the downhole tool to the conveyance line.

11. The apparatus of claim 10 wherein the first clamping member comprises a first channel configured to accommodate a first side of the conveyance line, and wherein the second clamping member comprises a second channel configured accommodate a second side of the conveyance line.

12. The apparatus of claim 10 wherein the first clamping member comprises a first textured surface configured to grip a first side of the conveyance line, and wherein the second clamping member comprises a second textured surface configured to grip a second side of the conveyance line.

13. The apparatus of claim 9 wherein the clamping member is or comprises a cam.

14. The apparatus of claim 9 wherein the downhole tool further comprises an actuator operable to pivot the clamping member to cause the clamping member to engage the conveyance line.

15. The apparatus of claim 14 wherein the actuator comprises:

a fluid chamber;

a piston slidably disposed within the fluid chamber;

a connecting member operatively connecting the piston and the clamping member; and the fluid source operable to move a fluid into the fluid chamber to cause the piston to move the connecting member and thereby pivot the clamping member to cause the clamping member to engage the conveyance line.

16. An apparatus comprising:

a downhole tool operable to be conveyed downhole within a wellbore along a conveyance line that conveys a tool string within the wellbore, connect to the conveyance line, and cut the conveyance line, wherein the downhole tool comprises:

a body;

a cutting member operable to cut the conveyance line; and a clamping mechanism comprising:

a first clamping member pivotably connected with the body;

a second clamping member connected with the body; and an actuator operable to pivot the first clamping member to cause the first clamping member to compress the conveyance line against the second clamping member to grip the conveyance line such that the conveyance line is inhibited from moving with respect to the first clamping member and the second clamping member thereby connecting the downhole tool to the conveyance line such that the downhole tool can be retrieved out of the wellbore via the conveyance line after the downhole tool cuts the conveyance line.

17. The apparatus of claim 16 wherein the first clamping member comprises a first channel configured to accommodate a first side of the conveyance line, and wherein the second clamping member comprises a second channel configured accommodate a second side of the conveyance line.

18. The apparatus of claim 16 wherein the first clamping member comprises a first textured surface configured to grip a first side of the conveyance line, and wherein the second clamping member comprises a second textured surface configured to grip a second side of the conveyance line.

19. The apparatus of claim 16 wherein the first clamping member is or comprises a cam.

20. The apparatus of claim 16 wherein the actuator comprises:

a fluid chamber;

a piston slidably disposed within the fluid chamber;

a connecting member operatively connecting the piston and the first clamping member; and the fluid source operable to move a fluid into the fluid chamber to cause the piston to move the connecting member and thereby pivot the first clamping member to cause the first clamping member to compress the conveyance line against the second clamping member.

* * * * *